US006501345B2

(12) United States Patent
Ota et al.

(10) Patent No.: US 6,501,345 B2
(45) **Date of Patent: *Dec. 31, 2002**

(54) FILTER, DUPLEXER, AND COMMUNICATIONS DEVICE

(75) Inventors: Michiaki Ota, Kyoto (JP); Seiji Hidaka, Nagaokakyo (JP); Shin Abe, Muko (JP)

(73) Assignee: Murata Manufacturing Co., Ltd. (JP)

( * ) Notice: Subject to any disclaimer, the term of this patent is extended or adjusted under 35 U.S.C. 154(b) by 34 days.

This patent is subject to a terminal disclaimer.

(21) Appl. No.: 09/732,108

(22) Filed: Dec. 7, 2000

(65) Prior Publication Data

US 2001/0002806 A1 Jun. 7, 2001

(30) Foreign Application Priority Data

Dec. 7, 1999 (JP) ..... 11-348011

(51) Int. Cl.[7] ..... H01P 1/203
(52) U.S. Cl. ..... 333/134; 333/204; 333/219
(58) Field of Search ..... 333/202, 204, 333/219, 134

(56) References Cited

U.S. PATENT DOCUMENTS 3,769,616 A 10/1973 Singh ..... 376/294
4,757,285 A 7/1988 Krause ..... 333/203
4,981,838 A 1/1991 Whitehead ..... 505/1
6,108,569 A * 8/2000 Shen ..... 505/210

FOREIGN PATENT DOCUMENTS

EP 0255068 A1 2/1988

OTHER PUBLICATIONS

U.R. Kraft, Polarisation Properties of Small Printed Spriral . . . , Apr. 1, 1997, pp. 131–135 XP000677383 IEE.

C.K. Ong et al., High–Temperature Superconducting . . . , Oct. 1999, pp. 407–09 XP000865049 IEEE.

* cited by examiner

*Primary Examiner*—Benny Lee
*Assistant Examiner*—Stephen E. Jones
(74) *Attorney, Agent, or Firm*—Dickstein, Shapiro, Morin & Oshinsky, LLP

(57) ABSTRACT

A filter, duplexer, and a communications device have significantly reduced power loss due to the edge effect, and the coupling structure between a resonator and an input or output terminal does not negatively affect the reduction of power loss. A plurality of resonators is provided on a dielectric substrate. Each of the resonators is constituted of a multiple spiral transmission line assembly. At the centers of the multiple spiral transmission assemblies at the input end and the output end, respectively, there are formed coupling pads which are capacitively coupled to associated multiple transmission line assemblies.

11 Claims, 20 Drawing Sheets

FILTER, DUPLEXER, AND COMMUNICATIONS DEVICE

CROSS-REFERENCE TO RELATED APPLICATION

This is related to Ser. No. 09/470,182 filed Dec. 22, 1999, pending, the disclosures of which are incorporated by reference herein.

BACKGROUND OF THE INVENTION

1. Field of the Invention

The present invention relates to filters, duplexers, and communications devices. More particularly, the present invention relates to a filter, a duplexer, and a communications device for use in radio communications or for transmission/reception of electromagnetic waves, for example, in the microwave or millimeter-wave band.

2. Description of the Related Art

A known resonator for use in the microwave or millimeter-wave band is the hairpin resonator disclosed in Japanese Unexamined Patent Application Publication No. 62-193302. The hairpin resonator allows a more compact construction than a resonator incorporating straight transmission lines.

Another known resonator, which also allows a more compact construction, is a spiral resonator disclosed in Japanese Unexamined Patent Application Publication No. 2-96402. The spiral resonator incorporates spiral transmission lines in order to contain longer transmission lines in a limited area, and also incorporates a resonant capacitor in order to allow even smaller overall dimensions.

The above resonators have each been implemented using a single half-wave transmission line. Thus, in the above resonators, electrical energy and magnetic energy accumulate in separate areas on a dielectric substrate thereof. More specifically, electrical energy accumulates in the proximity of the open ends of the half-wave transmission line, whereas the magnetic energy accumulates in the proximity of the center of the half-wave transmission line.

Such resonators having only one microstrip transmission line are subject to degradation of their characteristics due to the edge effect intrinsic in microstrip transmission lines. More specifically, current concentrates at the edges (side edges and top and bottom edges) of the transmission line as viewed in cross section. Use of thicker transmission lines does not eliminate the above problem.

SUMMARY OF THE INVENTION

Accordingly, the present invention provides a filter, a duplexer, and a communications device in which power loss due to the edge effect is significantly reduced and in which the coupling structure between a resonator and input/output terminals does not negatively affect the reduction of the edge effect.

To this end, the present invention, in one aspect thereof, provides a filter having a resonator and a coupling pad. The resonator includes a substrate and a transmission line assembly. The transmission line assembly is constituted of a plurality of spiral transmission lines disposed around a particular point on the substrate so as not to cross one another. The inner ends and outer ends of the plurality of spiral transmission lines substantially define, respectively, an inner circumference and an outer circumference of the transmission line assembly. The coupling pad is disposed at the center of the transmission line assembly, and is capacitively coupled to each of the plurality of spiral transmission lines.

The present invention, in another aspect thereof, provides a filter having a resonator and a coupling pad. The resonator includes a substrate and a transmission line assembly. The transmission line assembly is constituted of a plurality of spiral transmission lines disposed in rotational symmetry with one another around a particular point on the substrate so as not to cross one another. The coupling pad is disposed at the center of the transmission line assembly, and is capacitively coupled to each of the plurality of spiral transmission lines.

The present invention, in still another aspect thereof, provides a filter having a resonator and a coupling pad. The resonator includes a substrate and a transmission line assembly. The transmission line assembly is constituted of a plurality of transmission lines disposed on the substrate. Each of the plurality of transmission lines is represented by either a monotonically-increasing line or a monotonically-decreasing line on coordinates defined by an angle axis and a radius vector axis (see FIG. 2B for example). The line width of each of the plurality of transmission lines does not exceed an angle width of $2\pi$ radians divided by the number of the transmission lines. The width of the entirety of the transmission line assembly does not exceed the angle width of $2\pi$ radians at any radius vector. The coupling pad is disposed at the center of the transmission line assembly, and is capacitively coupled to each of the plurality of transmission lines.

In each of the above structures, spiral transmission lines which are substantially congruent with one another are disposed adjacent to one another. Microscopic edge effect appears slightly at the edges of each of the transmission lines; macroscopically, however, the side edges of the transmission lines can be disregarded. Therefore, concentration of current at the edges of the transmission lines is significantly alleviated, reducing power loss. The coupling pad is capacitively coupled to each of the transmission lines by an equal amount of capacitance, so that all the transmission lines have the same resonant frequency so as to achieve a minimized loss.

The coupling pad may be formed on the same plane as the transmission line assembly. This allows fabrication of both the coupling pad and the transmission lines substantially in a single step.

The coupling pad may be disposed so as to partially overlap the transmission line assembly, with a dielectric member interposed between the coupling pad and the transmission line assembly. This provides a greater capacitance between the coupling pad and each of the transmission lines, thereby allowing a smaller coupling pad. Therefore, flexibility of design is enhanced.

The substrate may be laminated onto another substrate provided with an input terminal and an output terminal, the coupling pad being connected, via a bump, to an electrode connected to one of the input terminal and the output terminal. The arrangement serves to allow more compact construction of the filter.

The present invention, in another aspect thereof, provides a duplexer having a filter in accordance with any of the features described above, as one or both of the transmitter filter and the receiver filter in the duplexer. The duplexer is compact and has a low insertion loss.

The present invention, in another aspect thereof, provides a communications device having either a filter in accordance with any of the features described above, or a duplexer as described above. The communications device has a low insertion loss and provides improved communications quality with regard to, for example, noise and transmission rate.

Other features and advantages of the present invention will become apparent from the following description of embodiments of the invention which refers to the accompanying drawings, in which like references denote like elements and parts.

DESCRIPTION OF EMBODIMENTS OF THE INVENTION

First, the principles of a resonator used in a filter according to the present invention are described with reference to FIGS. 1A to 10.

Figure 1A:
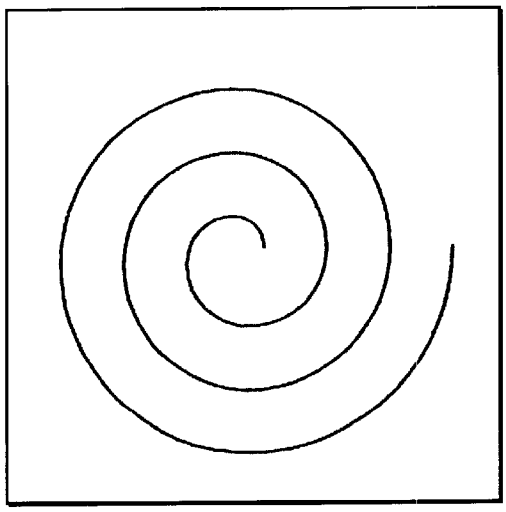
FIG. 1A is a plan view of a spiral transmission line.
Figure 1B:
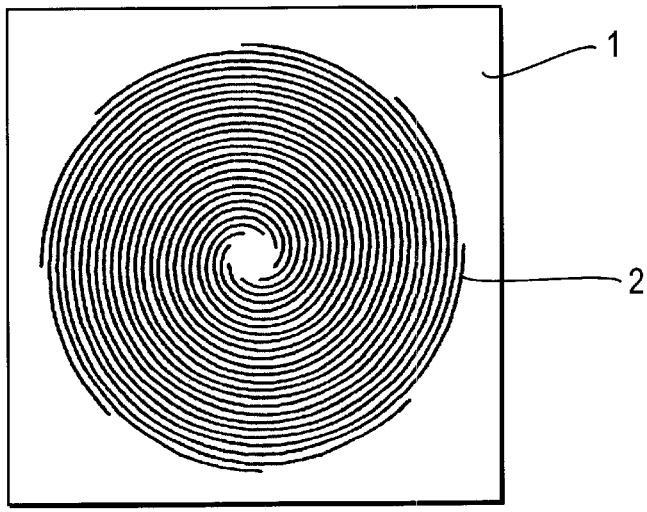
FIG. 1B is a plan view of a resonator incorporated in a filter according to the present invention.
Figure 1C:
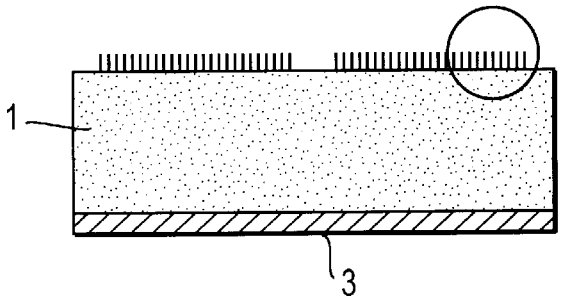
FIG. 1C is a sectional view of the filter.
Figure 1D:
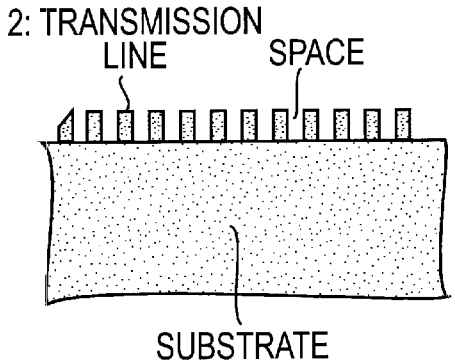
FIG. 1D is an enlarged fragmentary sectional view of the filter.

FIGS. 1B, 1C, and 1D are, respectively, a top plan view, a sectional view, and an enlarged fragmentary sectional view, each showing the construction of the resonator. Referring thereto, there are shown a dielectric substrate 1; a multiple spiral transmission line assembly 2 constituted of eight spiral transmission lines with both ends open, disposed on the top face of the dielectric substrate 1; and a ground electrode 3 which covers the entire bottom face of the dielectric substrate 1. The spiral transmission lines are congruent with one another, spiraling around a common center on the dielectric substrate 1 so as not to cross one another. The inner and outer ends of the spiral transmission lines substantially define, respectively, an inner circumference and an outer circumference of the spiral transmission line assembly 2. FIG. 1A shows one of the eight spiral transmission lines. The width of each of the spiral transmission lines is substantially equal to the skin depth thereof.

Figure 2A:
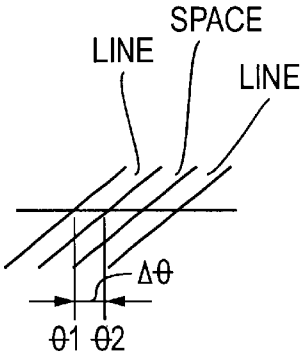
FIG. 2A is a diagram depicting an angle width of the transmission line.
Figure 2B:
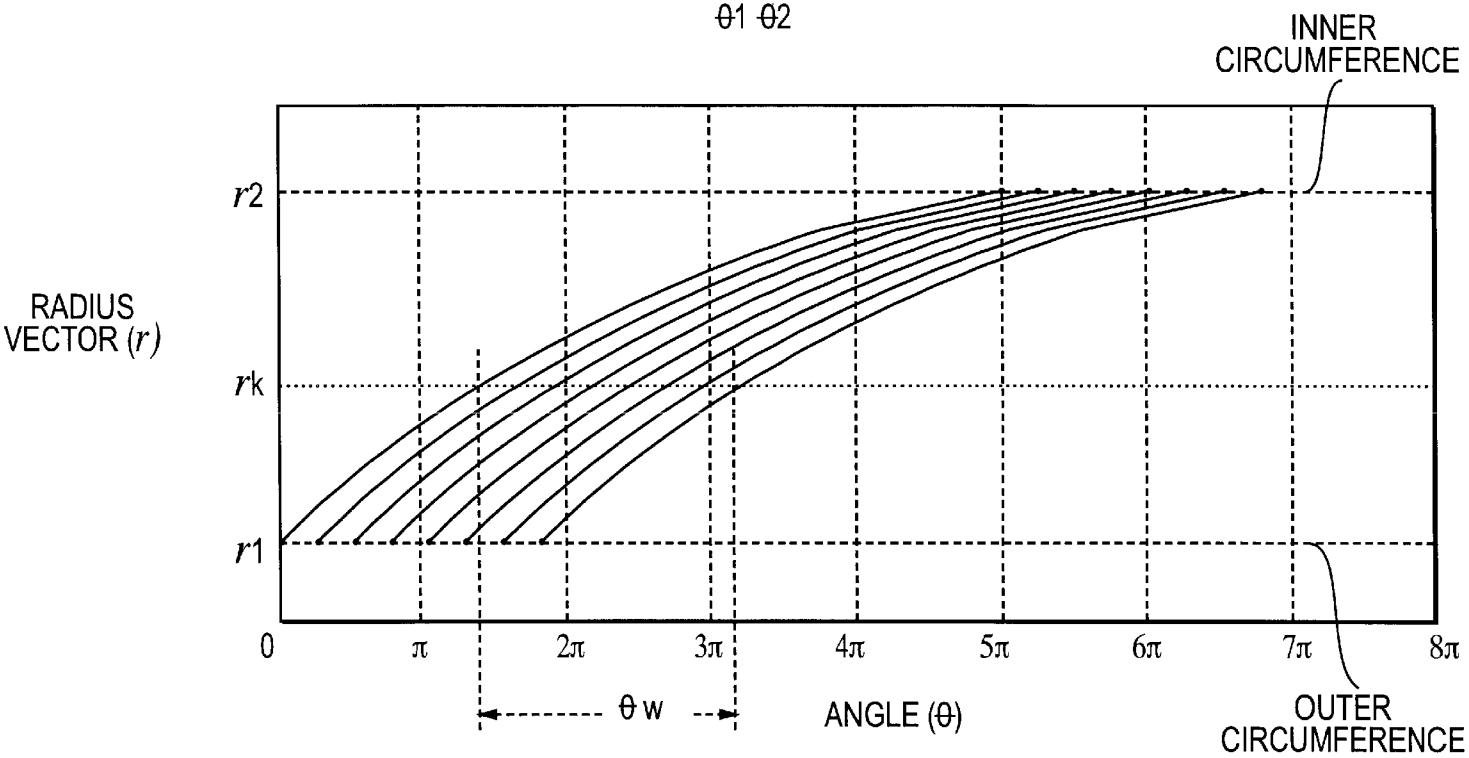
FIG. 2B is a graph showing a pattern of transmission lines using polar coordinate parameters.

Turning to FIG. 2B, the configuration of the multiple spiral transmission line assembly 2 shown in FIGS. 1A to 1D is now represented using polar coordinate parameters. All the eight spiral transmission lines have a common radius vector r1 for the inner end, and a common radius vector r2 for the outer end. Furthermore, the eight spiral transmission lines are regularly spaced along the angle axis. Referring to FIG. 2A, the angle width of each of the spiral transmission lines is expressed by $\Delta\theta=\theta2-\theta1$, where $\theta1$ is an angle of the left end, and $\theta2$ is an angle of the right end at a given radius vector. The number of the spiral transmission lines is n=8, which is derived from $\Delta\theta \leqq 2\pi/8$ ($=\pi/4$) radians. Turning again to FIG. 2B, the angle width θw of the entire multiple spiral transmission line assembly 2 at a given radius vector rk is within 2π radians.

The spiral transmission lines are inductively and capacitively coupled to one another so as to operate as a single resonator (a resonant line).

The spiral transmission lines need not necessarily have common radius vectors r1 and r2, nor be regularly spaced along the angle axis, nor be congruent with one another; however, the features described above will offer advantages in device characteristics and in the manufacturing process, as will be described later.

Figure 3A:
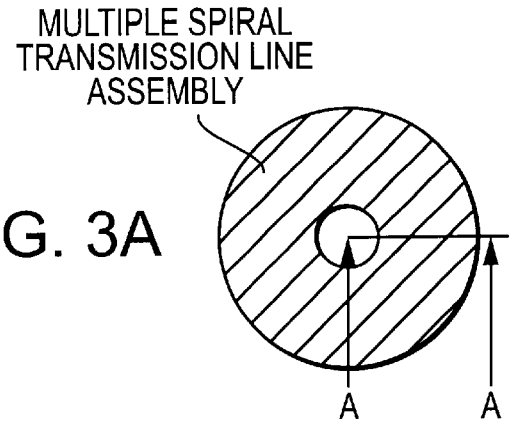
FIG. 3A is a plan view of the resonator.
Figure 3B:
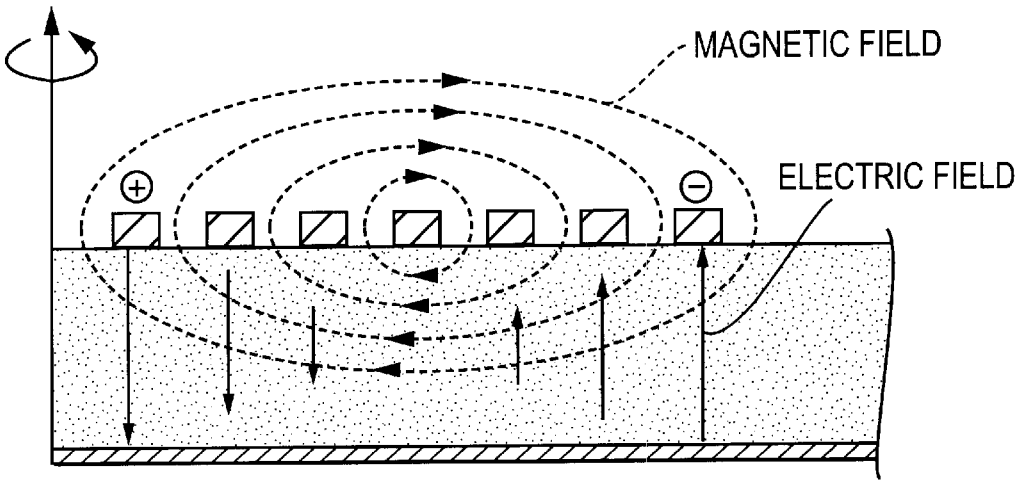
FIG. 3B is a vertical section showing the distribution of an electric field and a magnetic field in the resonator.
Figure 3C:
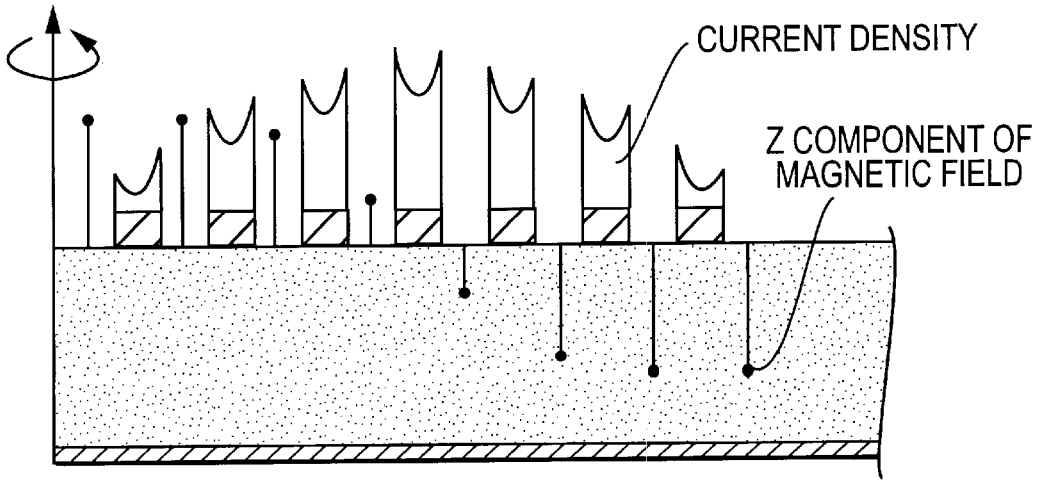
FIG. 3C is a vertical section showing current density and the z component of the magnetic field in the resonator.

FIG. 3A schematically shows the multiple spiral transmission line assembly 2, the spiral transmission lines not being shown individually. FIG. 3B depicts the distribution of the electrical field and the magnetic field on the assembly 2, as viewed in section taken along the line A—A in FIG. 3A, when the charges at the inner end and the outer end are at maximum. FIG. 3C depicts the current densities on each of the transmission lines and the averages of z components (perpendicular to the page) of the magnetic field passing through each of the spaces between adjacent transmission lines.

Microscopically, current density is large at each of the edges of the transmission lines as shown in FIGS. 3B and 3C. Macroscopically, however, the edge effect is significantly alleviated, because currents having the same amplitude and phase flow through adjacent transmission lines.

Figure 4A:
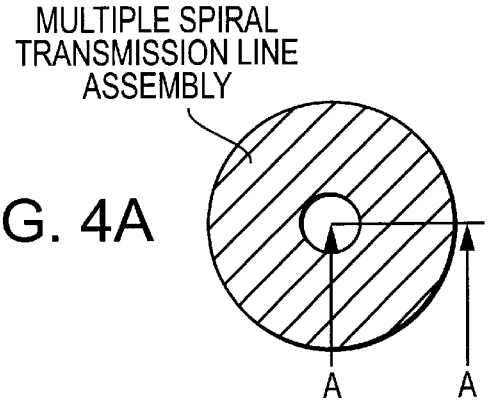
FIG. 4A is a plan view of another resonator.
Figure 4B:
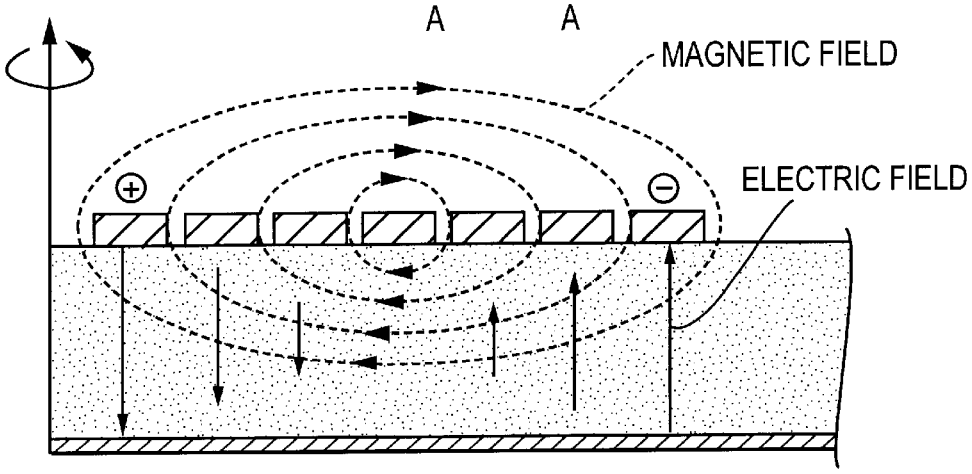
FIG. 4B is a vertical section showing the distribution of an electric field and a magnetic field in the resonator of FIG. 4A.
Figure 4C:
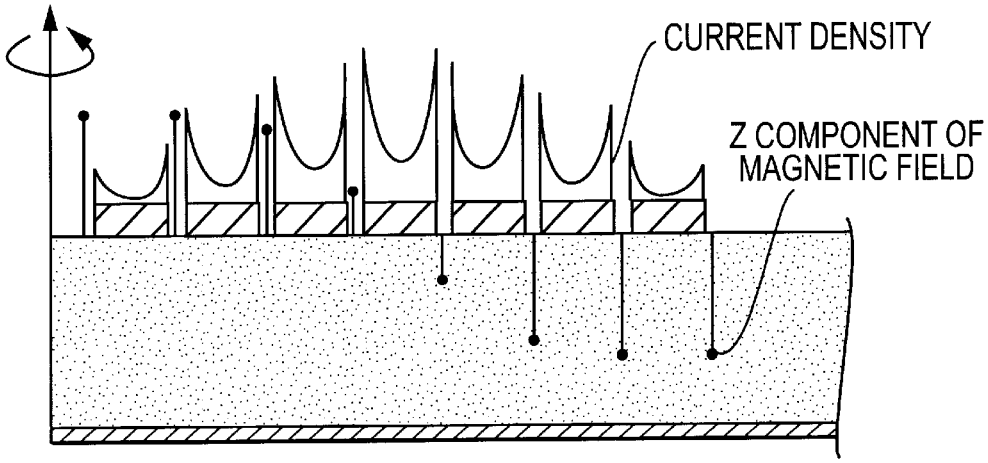
FIG. 4C is a vertical section showing current density and the z component of the magnetic field in the resonator of FIG. 4A.

FIGS. 4A–4C show a comparative example, in which the width of each of the transmission lines is increased to about twice the skin depth. Concentration of current is more apparent than in FIGS. 3A–3C, and the reduction of power loss is negatively affected.

The distributions of electric and magnetic fields as shown in FIGS. 3A to 4C cannot be obtained without a three-dimensional analysis, which requires a great deal of computation. Hereinbelow, we describe the results of static magnetic field simulations of the distribution of magnetic fields generated by a plurality of line current sources.

(Simulation models)

Figure 5:
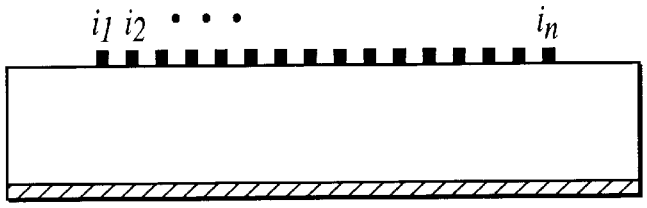
FIG. 5 is a vertical section of a microstrip multiple transmission line assembly used as a simulation model.

FIG. 5 shows a simulation model of a plurality of line current sources.

Model 1 (Currents have the same phase and amplitude.)

$$i_k = A/\sqrt{2},\ (k=1,\ 2,\ \bullet\bullet\bullet,\ n)$$

Model 2 (Phase difference of current varies between 0° to 180°, the amplitude varies as a sine wave.)

$$i_k = A\ \sin\{(2k-1)\pi/2n\},\ (k=1,\ 2,\ \bullet\bullet\bullet,\ n)$$

(Calculation of the distribution of magnetic field)

The distribution of the magnetic field is calculated in accordance with the Biot-Savart law.

The magnetic vector generated by a line current source passing a point (p) on the x–y plane and flowing infinitely in the Z direction is expressed by the following equation (1).

$$H = \frac{\mu_0 I_0 e_z \times (r-p)}{4\pi (r-p)^2} \tag{1}$$

Thus, the distribution of the magnetic field generated by a plurality of line current sources in this simulation model is obtained by the following equation (2).

$$H = \sum_k \frac{\mu_0 i_k}{4\pi}\left(\frac{e_x \times (r-p_k)}{(r-p_k)^2} - \frac{e_x \times \left(r-p_k^{(m)}\right)}{\left(r-p_k^{(m)}\right)^2}\right) \tag{2}$$

In the above equation (2), $p_k(m)$ is the coordinate value of the mirror image position of $p_k$ with respect to the ground electrode. The minus sign indicates that the currents flow in the opposite directions.

(Example of calculation)

Parameters

Number of transmission lines: n=20

Total line width: $w_o$=0.5 mm

Substrate thickness $h_o$=0.5 mm

Coordinate value of line current source $$x_k = [\{(2k-1)/2n\} - (½)]w_o$$

$$y_k = h_o$$

$$(k=1,\ 2,\ \bullet\bullet\bullet,\ n)$$

Figure 6A:
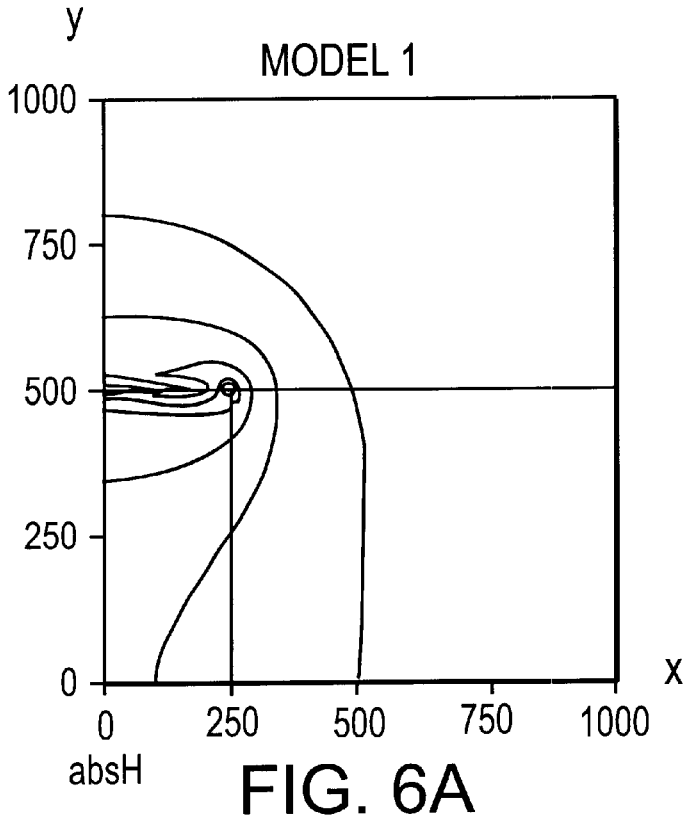
FIG. 6A is a graph showing the distribution of the magnetic field in a first simulation model.
Figure 6B:
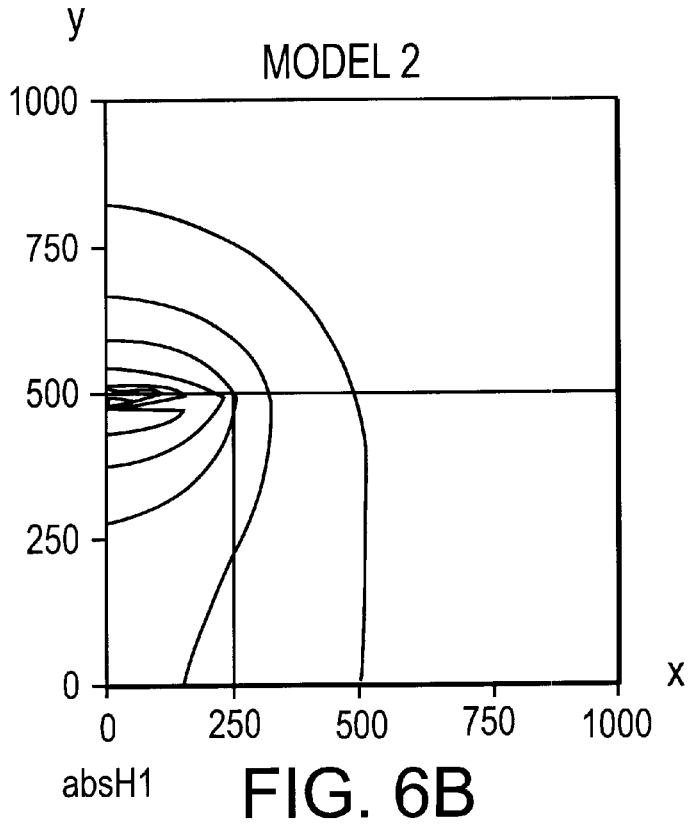
FIG. 6B is a graph showing the distribution of the magnetic field in a second simulation model.

FIGS. 6A and 6B show the distribution of magnetic fields in Model 1 and Model 2, respectively. Referring to FIGS. 6A and 6B, the vertical auxiliary line and the horizontal auxiliary line indicate, respectively, the edge of the multiple spiral transmission line assembly and the substrate surface. In Model 2, the equiphase lines are less dense both in the x direction and in the y direction, and thus power loss is smaller.

Figure 7A:
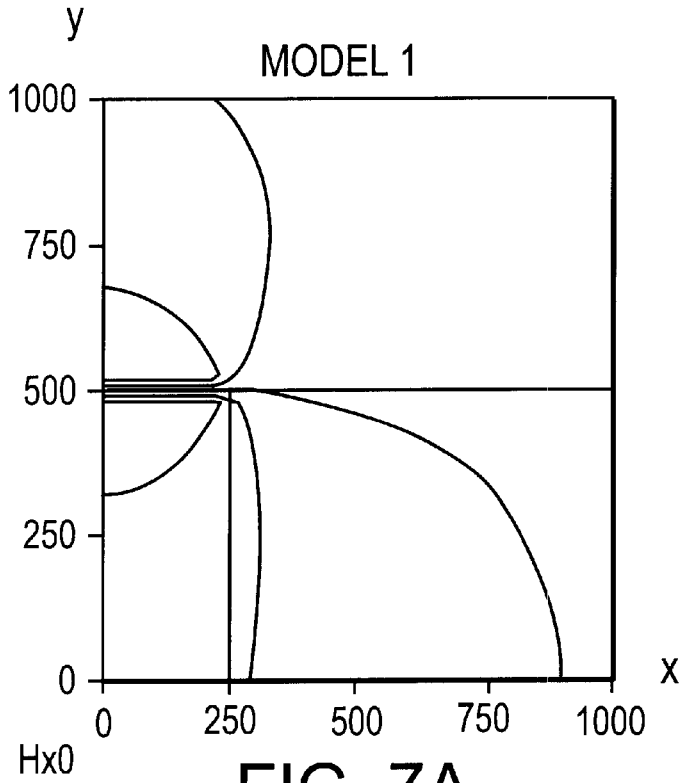
FIG. 7A is a graph showing the distribution of the x component of the magnetic field in the first model.
Figure 7B:
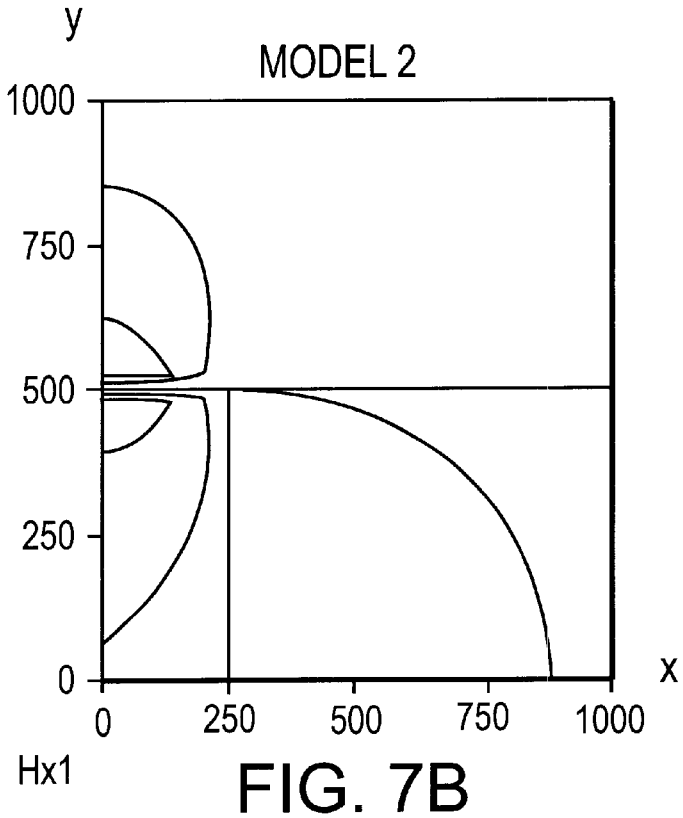
FIG. 7B is a graph showing the distribution of the x component of the magnetic field in the second model.

FIGS. 7A and 7B show the x component of the magnetic fields in Model 1 and Model 2, respectively. Referring to FIGS. 7A and 7B, the vertical auxiliary line and the horizontal auxiliary line indicate, respectively, the edge of the multiple transmission line assembly and the substrate surface. Model 2 provides better isolation and thus is advantageous for integration in, for example, filters.

Figure 8A:
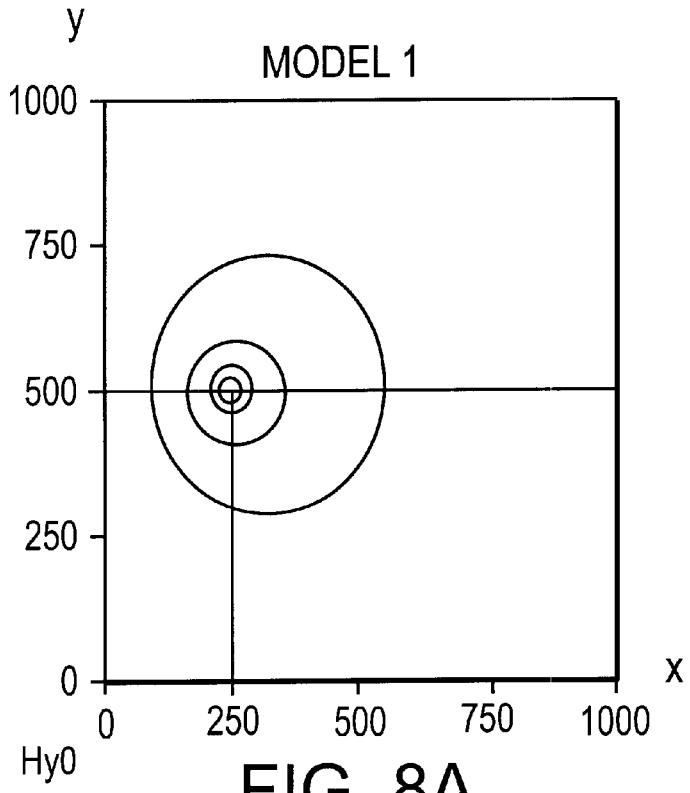
FIG. 8A is a graph showing the distribution of the y component of the magnetic field in the first model.
Figure 8B:
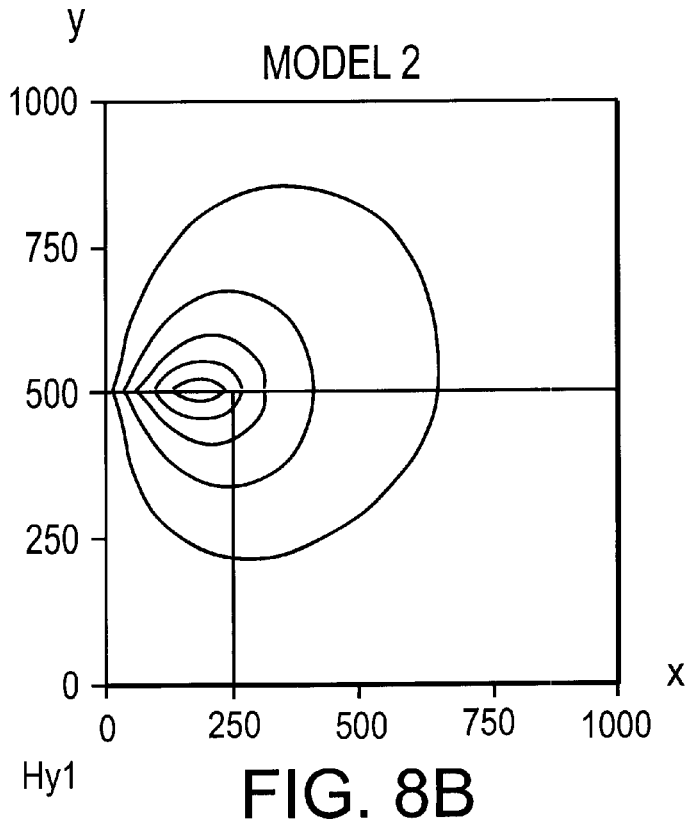
FIG. 8B is a graph showing the distribution of the y component of the magnetic field in the second model.

FIGS. 8A and 8B show the y component of the magnetic fields in Model 1 and Model 2, respectively. Referring to FIGS. 8A and 8B, the vertical auxiliary line and the horizontal auxiliary line indicate, respectively, the edge of the multiple transmission line assembly and the substrate surface. In Model 2, concentration of the magnetic field at the edges of the transmission lines is less intense, and thus power loss is less.

Figure 9:
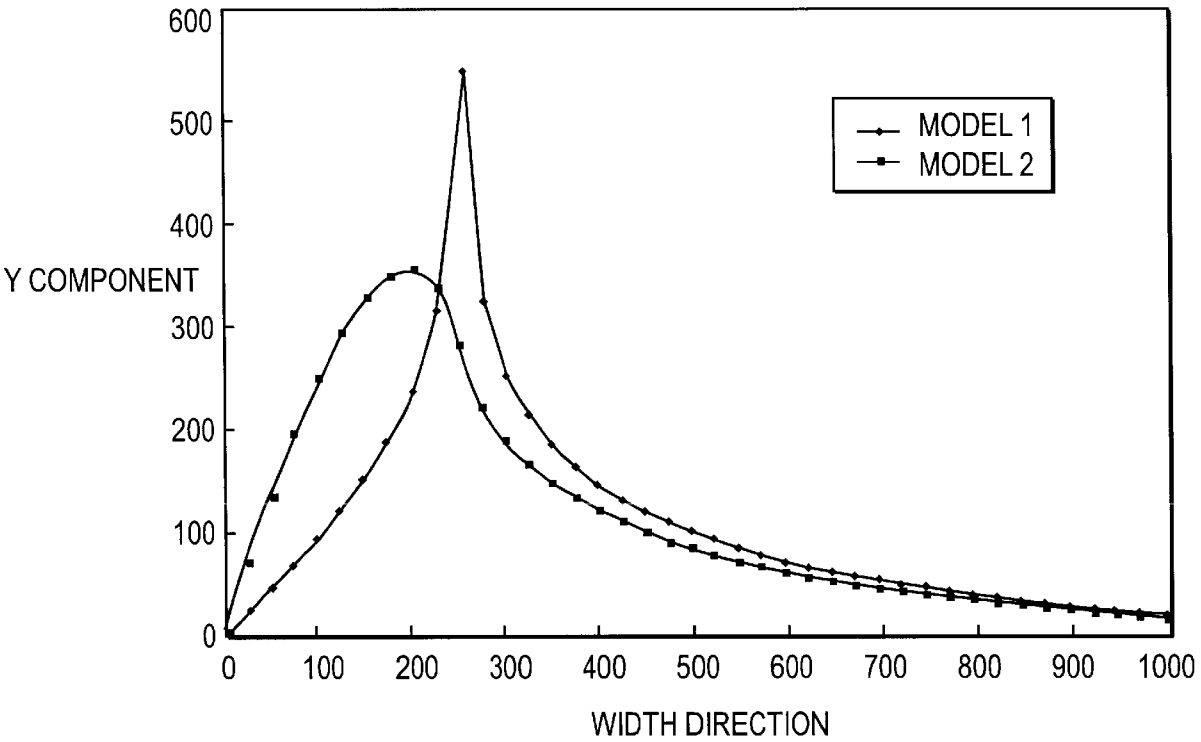
FIG. 9 is a graph showing the y component of the magnetic field along the x axis.

FIG. 9 is a graph showing the y component of the magnetic field along the x axis.

Figure 10:
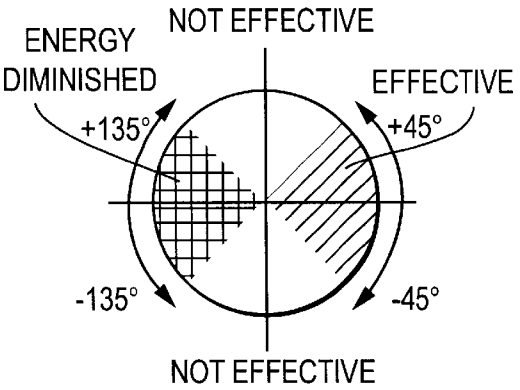
FIG. 10 is a diagram showing the relationship between phase difference of current and power loss.

The suppression of the edge effects as described above is greatest when the phase difference of currents flowing in adjacent transmission lines is minimal at any point of the transmission lines. FIG. 10 shows the relationship between the phase difference and power loss. The oscillation energy is most effectively maintained when the phase difference is 0°. The reduction of power loss is offset by reactive current when the phase difference is 90°. When the phase difference is ±180°, the oscillation energy is diminished. Thus, a range of ±45° can be regarded as an effective range.

The principles of the design of planar-circuit resonators can be summarized as follows.

(1) A plurality of transmission lines, which are congruent with one another and are mutually insulated, are disposed in rotational symmetry. Thus, the physical length, electrical length, and the oscillation frequencies of the transmission lines are equivalent. In addition, the equiphase lines on the substrate surface are distributed so as to form concentric circles. Electromagnetically, the edges are substantially absent, and thus power loss due to the edge effect is significantly suppressed.

(2) The phase difference of currents flowing through adjacent transmission lines should be minimal at any point on the transmission lines. The width of each of the transmission lines and the spacings between adjacent transmission lines should be made as small as possible, and should be substantially constant at any point without any abrupt bending. Each of the transmission lines should be made so as not to make contact between one portion and another portion thereof.

(3) The width of each of the transmission lines should not be greater that the skin depth thereof. Magnetic fields at the edges of adjacent transmission lines interfere with each other so as to increase the effective current and decrease the reactive current, thereby reducing power loss.

Next, the construction of a filter according to a first embodiment of the present invention is described with reference to FIGS. 11 to 16B.

Figure 11:
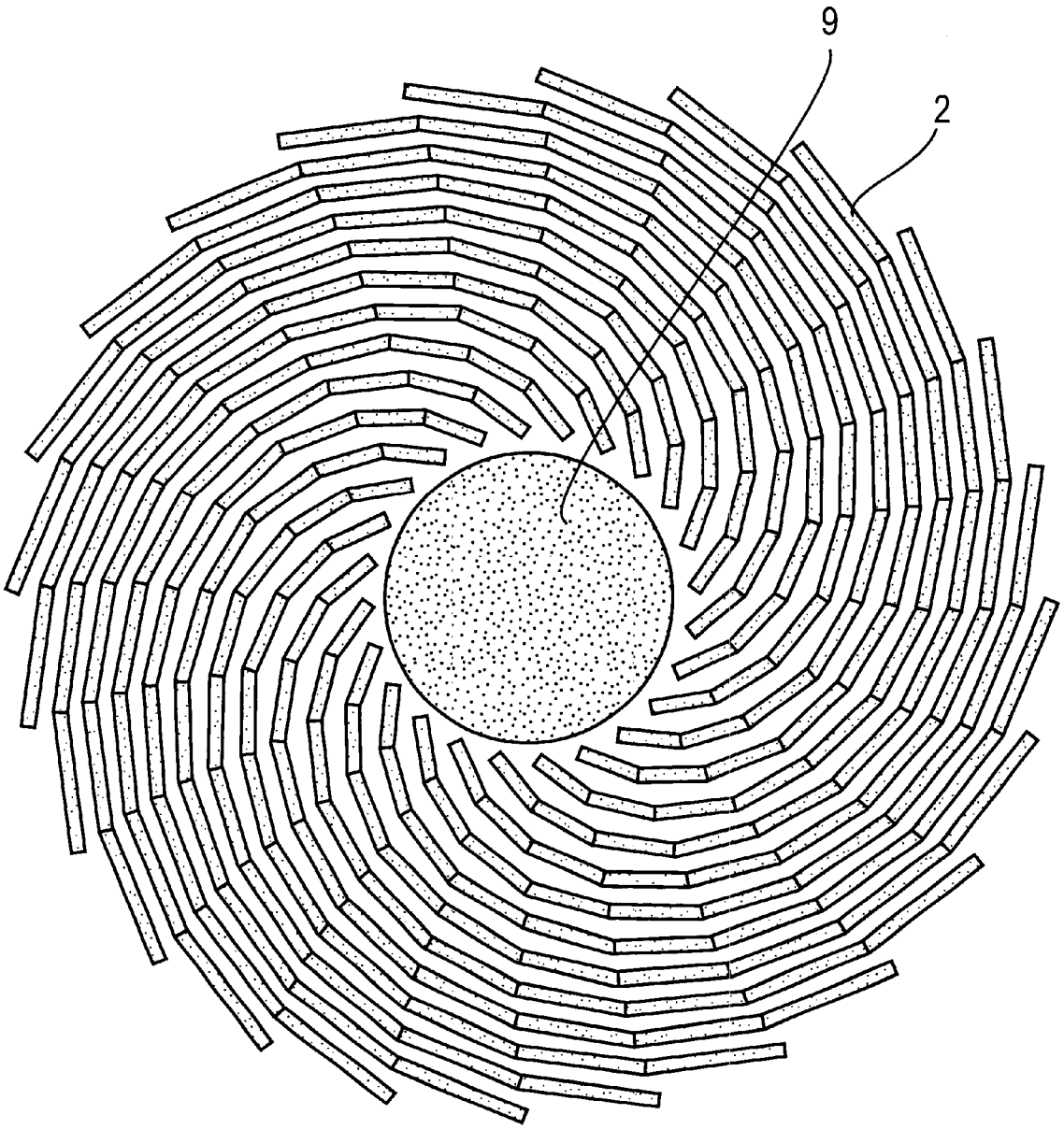
FIG. 11 is a plan view of a multiple spiral transmission line assembly incorporated in a first embodiment of the present invention.

FIG. 11 is an enlarged plan view of a multiple spiral transmission line assembly 2. Disposed at the center of the assembly 2 is a coupling pad 9 which is an electrode for coupling with the assembly 2. The spiral transmission lines of the assembly 2 are congruent with one another, and are disposed in rotational symmetry with one another around a particular point on a substrate so as not to cross one another. The coupling pad 9 defines a circle around the particular point, not abutting any of the spiral transmission lines. Accordingly, the coupling pad 9 is coupled, by an equal amount of capacitance, to each of the inner ends of the spiral transmission lines. The coupling coefficient between the assembly 2 and the coupling pad 9 depends on the radius of the coupling pad 9, and the gap between the coupling pad 9 and the assembly 2. The radius and the gap are determined so as to provide a coupling coefficient as desired for particular filters.

Figure 12:
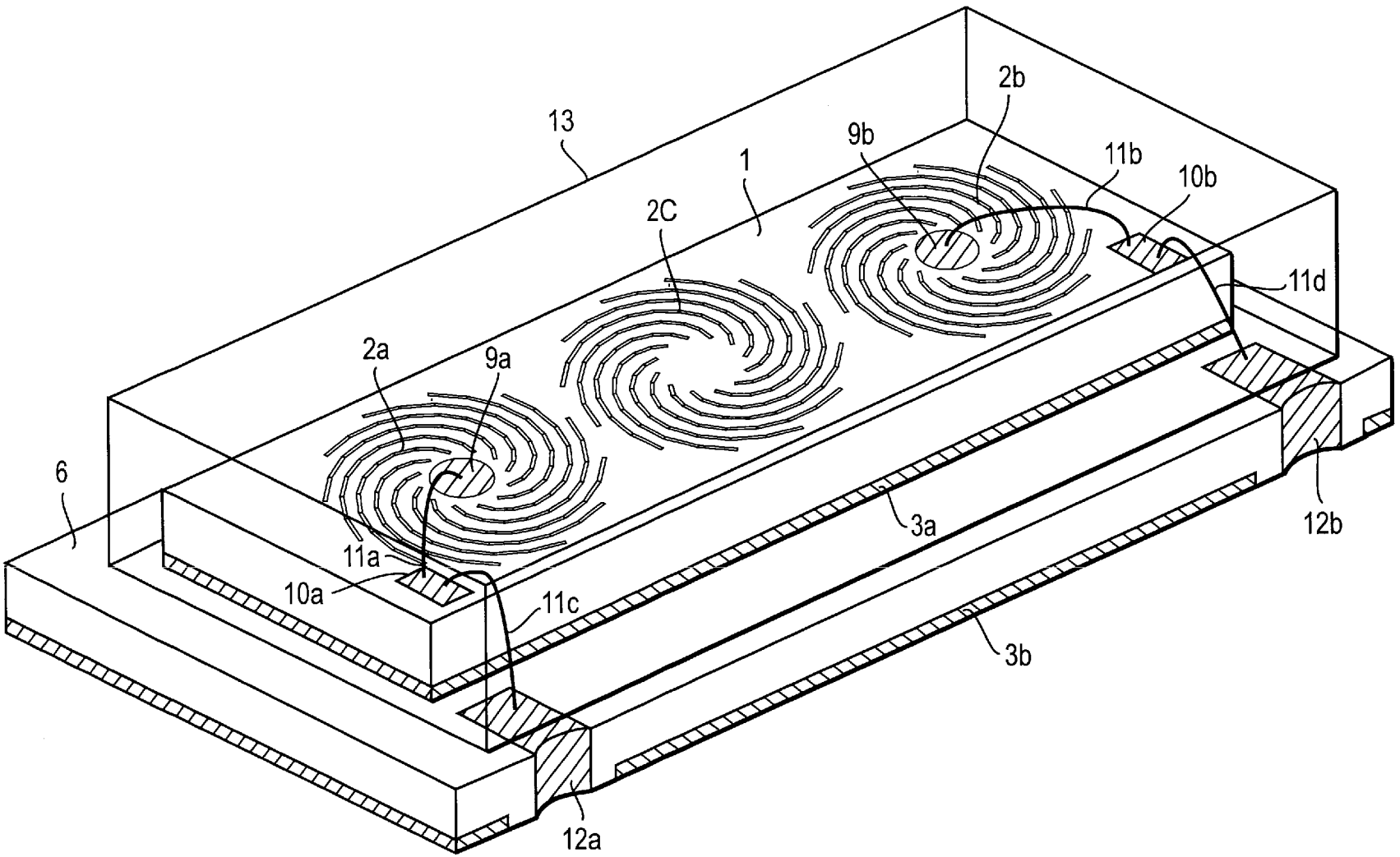
FIG. 12 is a perspective view of a filter according to the first embodiment.

FIG. 12 is a perspective view of an entire filter. Referring to FIG. 12, three multiple spiral transmission line assemblies 2*a,* 2*b,* and 2*c* are provided on the top face of a dielectric substrate 1 which may be, for example, an alumina ceramic substrate or a glass epoxy substrate. At the centers of the assemblies on both ends, 2*a* and 2*b,* there are formed coupling pads 9*a* and 9*b,* respectively. Also formed on the top face of the dielectric substrate 1 are bonding pads 10*a* and 10*b*. The entire bottom face of the dielectric substrate 1 is substantially covered by a ground electrode 3*a*.

The dielectric substrate 1 is fixed to a substrate 6 which is either insulating or dielectric. On the substrate 6, there are formed input and output terminals 12*a* and 12*b* each extending from the top face, via a side face, to the bottom face thereof. The entire bottom face of the substrate 6 is substantially covered by a ground electrode 3*b,* except where the input and output terminals 12*a* and 12*b* are formed.

The coupling pads 9*a* and 9*b* are respectively wire-bonded to the bonding pads 10*a* and 10*b* via bonding wires 11*a* and 11*b*. Also, the bonding pads 10*a* and 10*b* are respectively wire-bonded to the input and output terminals 12*a* and 12*b* via bonding wires 11*c* and 11*d*. The dielectric substrate 1 and the bonding wires 11*a* to 11*d,* in order to be electromagnetically shielded, are covered by a metallic cap 13 bonded onto the top face of the substrate 6 using an insulative bonding agent. In FIG. 12, the cap 13 is drawn in phantom.

In accordance with the above structure, the coupling pad 9*a* is capacitively coupled to the multiple spiral transmission line assembly 2*a*. The multiple spiral transmission line assembly 2*a* is inductively coupled to the middle multiple spiral transmission line assembly 2*c,* and is thereby also inductively coupled to the multiple spiral transmission line assembly 2*b* at the other end. The multiple spiral transmission line assembly 2*b* is capacitively coupled to the coupling pad 9*b*. The input and output terminals 12*a* and 12*b* are electrically connected to the coupling pads 9*a* and 9*b,* respectively. Accordingly, signals are filtered between the input and output terminals 12*a* and 12*b* in accordance with the band-pass characteristics determined by the three resonators.

The coupling pads 9*a* and 9*b* may be directly wire-bonded to the input and output terminals 12*a* and 12*b* without interposing the bonding pads 10*a* and 10*b* therebetween on the dielectric substrate 1.

A bonding pad (not shown) may also be provided at the center of the multiple spiral transmission line assembly 2*c* in addition to the coupling pads 9*a* and 9*b,* thereby setting an oscillation frequency for each of the assemblies 2*a,* 2*b,* and 2*c*.

Instead of or in addition to the coupling pads 9*a* and 9*b,* electrodes for capacitive coupling may be provided outside and adjacent to the outer circumferences of the assemblies 2*a* and 2*b,* respectively.

FIGS. 13A to 16B show examples of modifications of the coupling structure between the multiple spiral transmission line assembly 2 and the coupling pad 9, which serve to provide a greater coupling capacitance between the assembly 2 and the coupling pad 9.

Figure 13A:
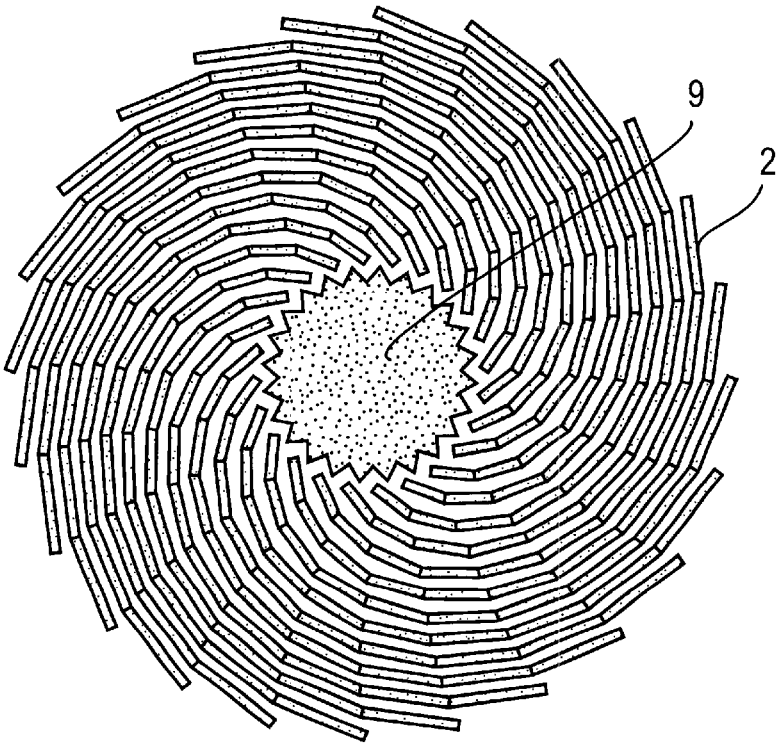
FIG. 13A is a plan view showing a modification of the shape of the coupling pad.
Figure 13B:
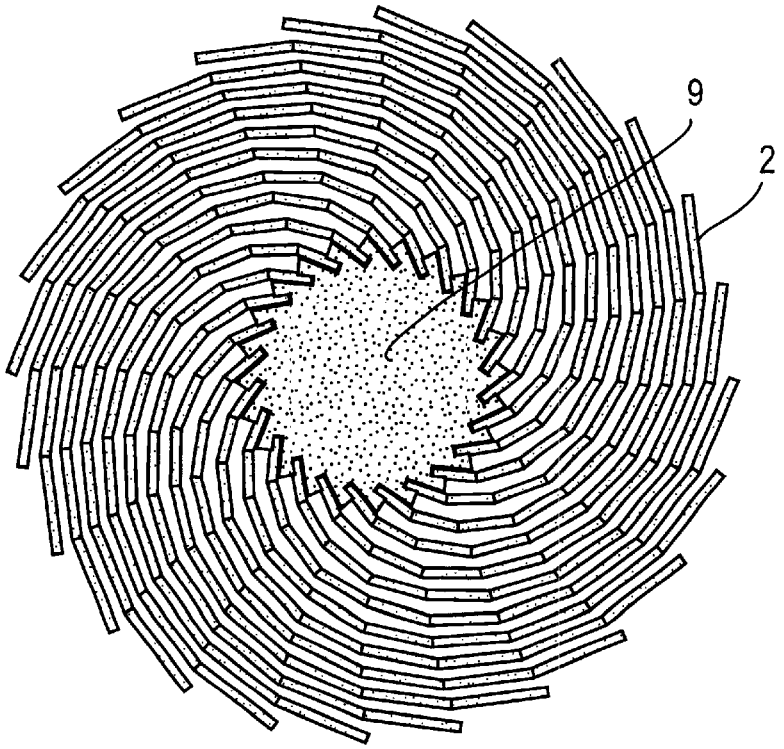
FIG. 13B is a plan view showing another modification of the shape of the coupling pad.

FIGS. 13A and 13B show modifications in which the shape of the coupling pad 9 is altered. In FIG. 13A, the coupling pad 9 is toothed so as to narrow the gap with the assembly 2. In FIG. 13B, the teeth of the coupling pad 9 are further extended into the spaces between adjacent pairs of the spiral transmission lines constituting the assembly 2.

FIGS. 14A to 16B show modifications in which a dielectric film 14 is provided between the assembly 2 and the coupling pad 9.

Figure 14A:
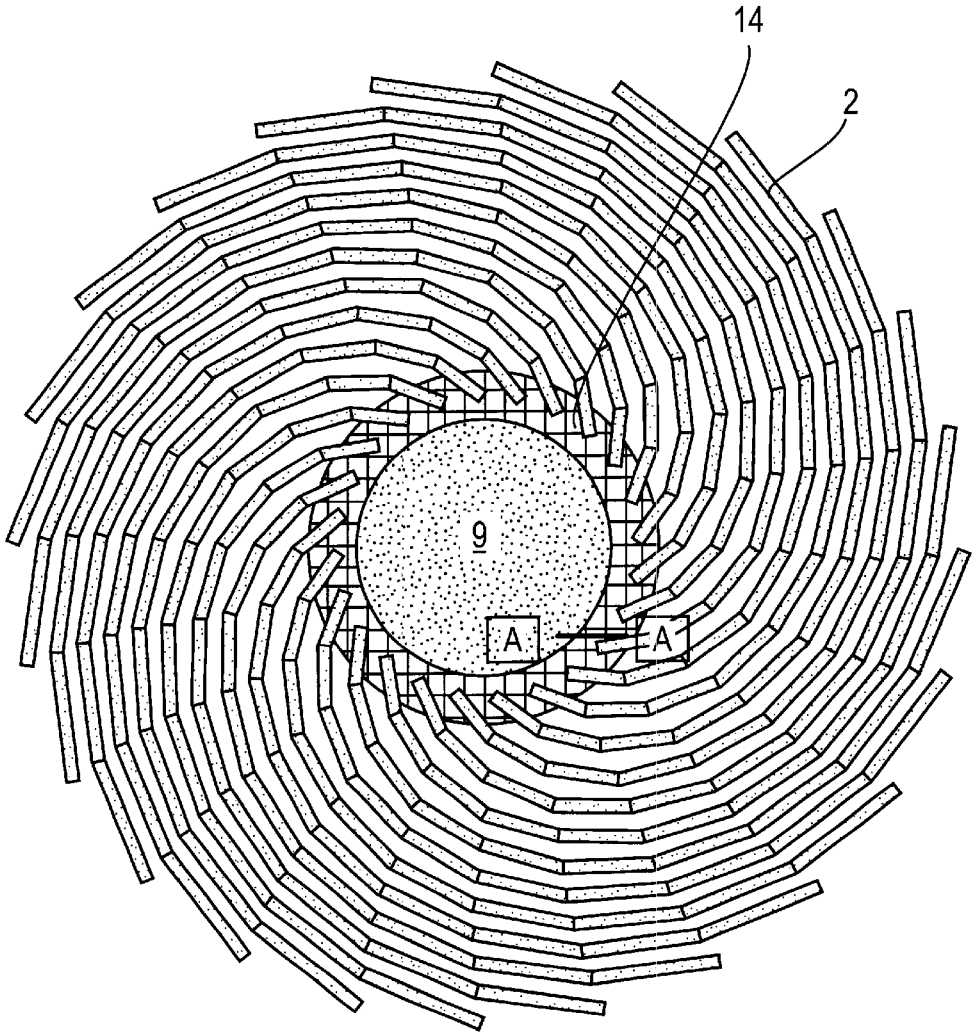
FIG. 14A is a plan view showing a modification of the coupling structure between the coupling pad and the multiple spiral transmission line assembly.
Figure 14B:
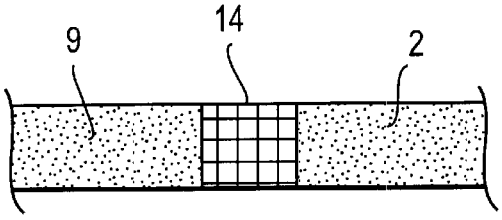
FIG. 14B is a vertical section taken along the line A—A in FIG. 14A.

In FIG. 14A, the dielectric film 14 is formed around the coupling pad 9 to extend into the spaces between the inner end portions of adjacent pairs of the spiral transmission lines. FIG. 14B shows a vertical section taken along the line A—A in FIG. 14A. Alternatively, the dielectric film 14 may be formed around the coupling pad 9 to extend over the entire area where the assembly 2 is formed, or over the entire substrate.

Figure 15A:
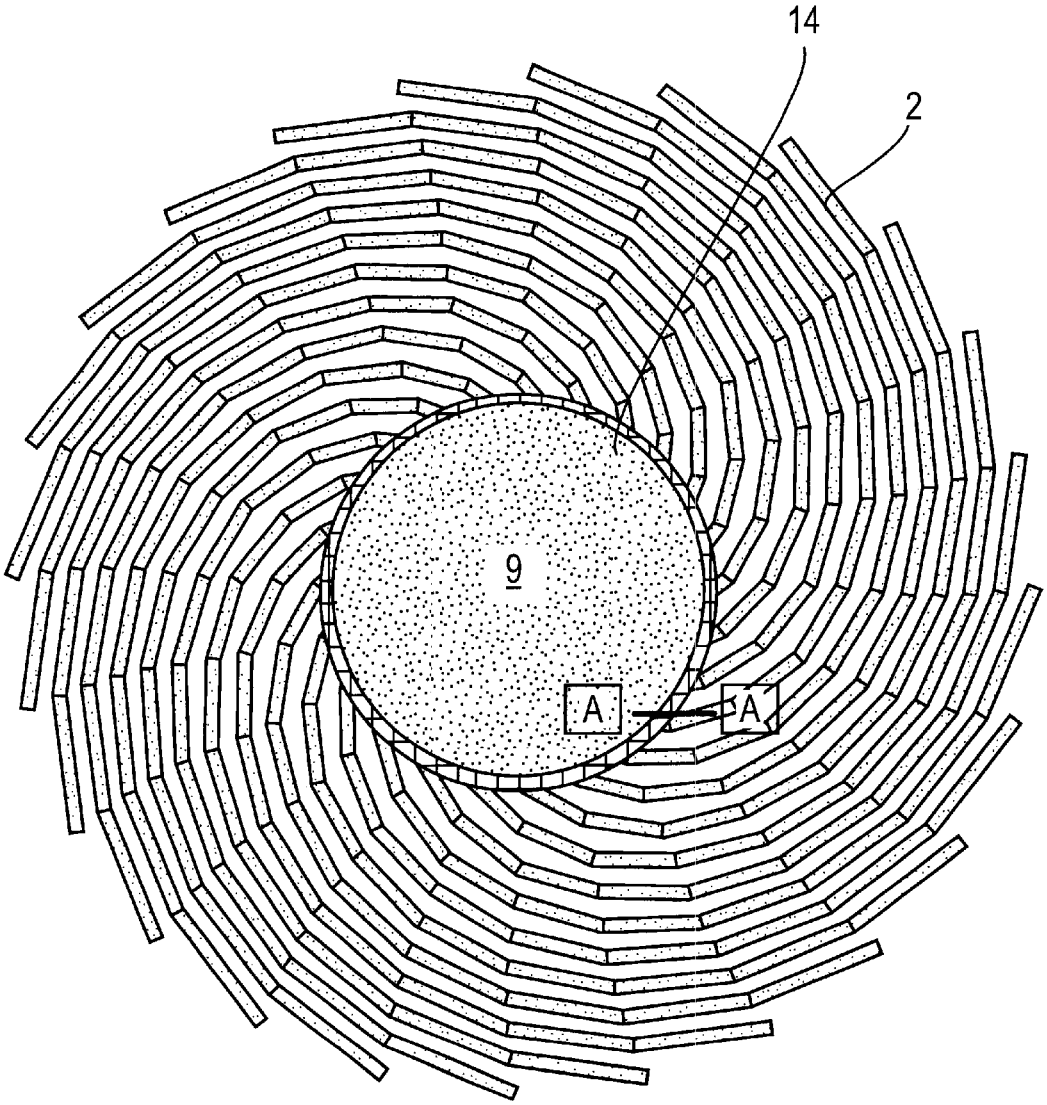
FIG. 15A is a plan view showing another modification of the coupling structure between the coupling pad and the multiple spiral transmission line assembly.
Figure 15B:
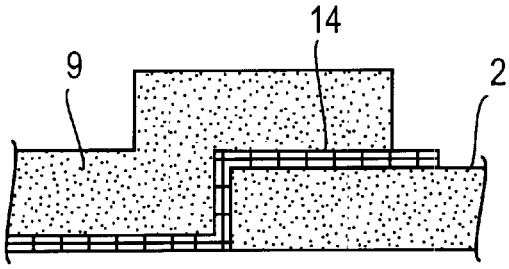
FIG. 15B is a vertical section taken along the line A—A in FIG. 15A.

In FIG. 15A, the dielectric film 14 is formed in a circular shape covering the inner end portions of the spiral transmission lines, and the coupling pad 9 is formed on the dielectric film 14. FIG. 15B shows a vertical section taken along the line A—A in FIG. 15A.

Figure 16A:
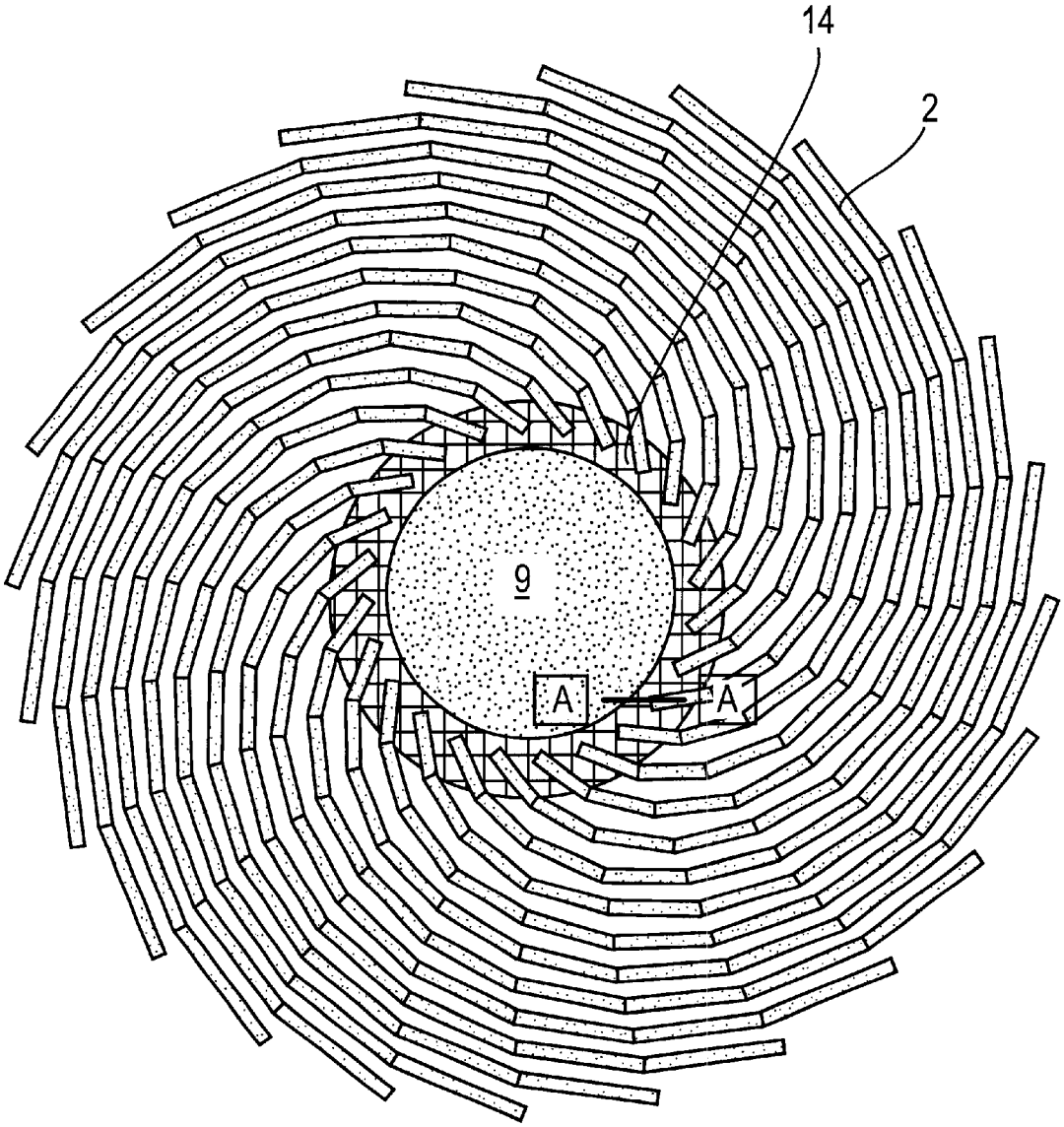
FIG. 16A is a plan view showing still another modification of the coupling structure between the coupling pad and the multiple spiral transmission line assembly.
Figure 16B:
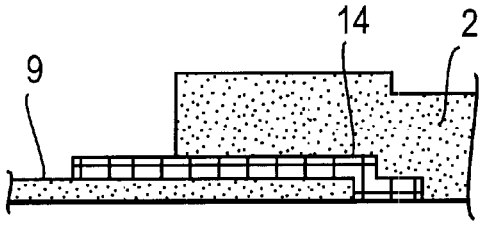
FIG. 16B is a vertical section taken along the line A—A in FIG. 16A.

In FIG. 16A, the coupling pad 9 is formed in a circular shape on the substrate, the dielectric film 14 is formed in a ring shape along and covering the circumference of the coupling pad 9, and the multiple spiral transmission line assembly 2 is formed on the substrate so as to cover, via the dielectric film 14, parts of the circumference of the coupling pad 9. FIG. 16B shows a vertical section taken along the line A—A in FIG. 16A.

Next, the construction of a filter according to a second embodiment of the present invention is described with reference to FIG. 17.

Figure 17:
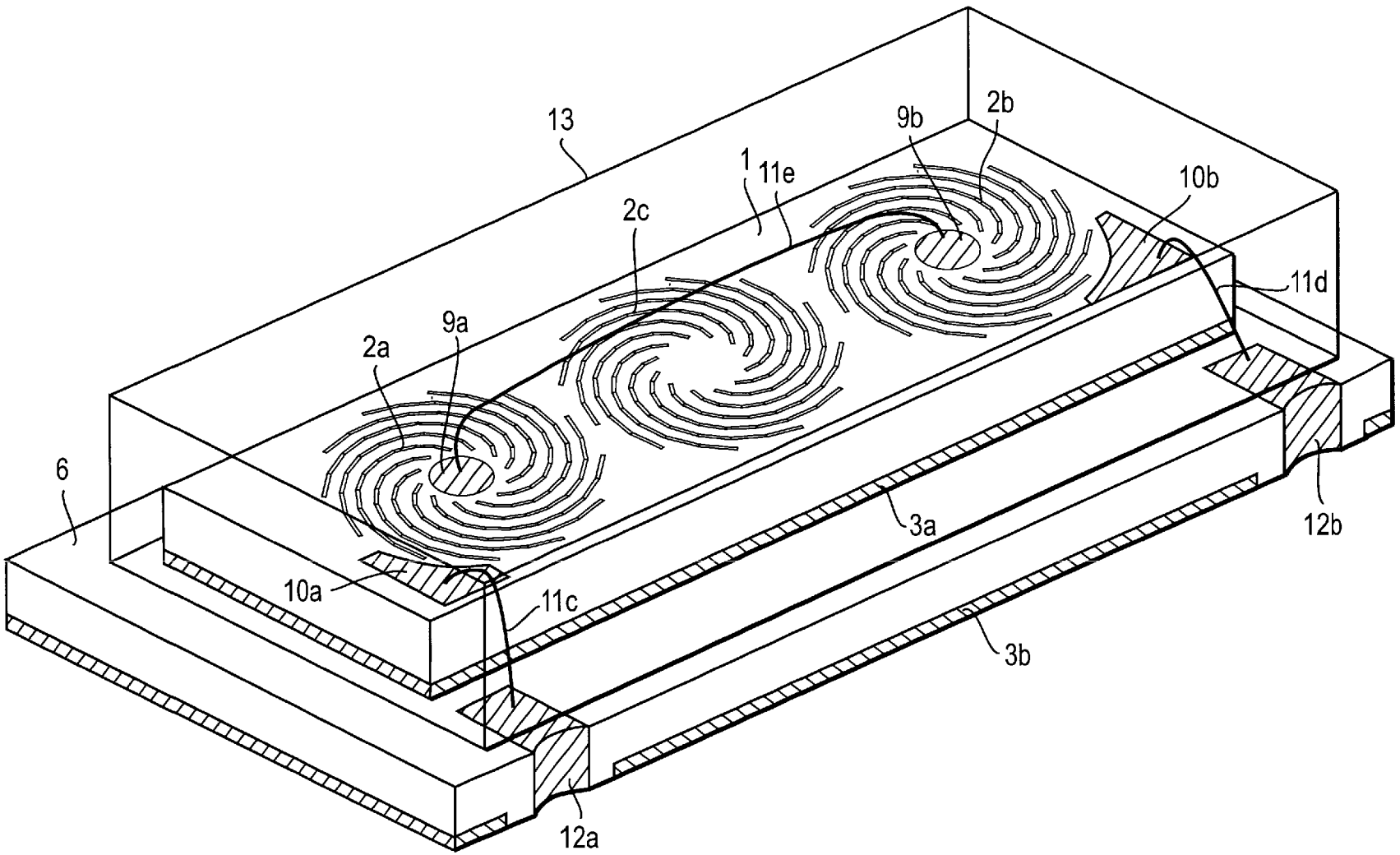
FIG. 17 is a perspective view of a filter according to a second embodiment of the present invention.

Referring to FIG. 17, three multiple spiral transmission line assemblies 2*a,* 2*b,* and 2*c* are provided on the top face of a dielectric substrate 1. At the centers of the end assemblies 2*a* and 2*b,* there are formed coupling pads 9*a* and 9*b,* respectively. Adjacent to the outer circumferences of each of the assemblies 2*a* and 2*b,* there are formed bonding pads 10*a* and 10*b*. The entire bottom face of the dielectric substrate 1 is substantially covered by a ground electrode 3*a*. The dielectric substrate 1 is fixed to a substrate 6 which is either insulating or dielectric. On the substrate 6, there are formed input and output terminals 12*a* and 12*b* each extending from the top face, via a side face, to the bottom face thereof. The entire bottom face of the substrate 6 is substantially covered by a ground electrode 3*b*, except where the input and output terminals 12*a* and 12*b* are formed.

Unlike the first embodiment shown in FIG. 12, the bonding pads 9*a* and 9*b* are wire-bonded with each other via a bonding wire 11*e*. The bonding pads 10*a* and 10*b*, respectively, are wire-bonded to the input and output terminals 12*a* and 12*b* via bonding wires 11*c* and 11*d*. The dielectric substrate 1 and the bonding wires 11*a* to 11*d* are covered by a metallic cap 13 disposed on the top face of the substrate 6.

The coupling pads 9*a* and 9*b* are capacitively coupled respectively to multiple spiral transmission line assemblies 2*a* and 2*b*, and the bonding pads 10*a* and 10*b* are also capacitively coupled respectively to multiple spiral transmission line assemblies 2*a* and 2*b*. Accordingly, the multiple spiral transmission line assemblies 2*a* and 2*b* are coupled via capacitive reactance, thereby attenuating the components of predetermined frequencies.

Alternatively, the arrangement (not shown) may be such that the bonding pads 10*a* and 10*b* are wire-bonded with each other and the coupling pads 9*a* and 9*b* are wire-bonded respectively to the input and output terminals 12*a* and 12*b*.

The arrangement (not shown) may also be such that, at either the input or the output end, the coupling pad is used for coupling with the other end and the bonding pad is connected to the input or output terminal; and at said other end, the coupling pad is connected to the input or output terminal and the bonding pad is used for coupling with the first-mentioned end.

Next, the construction of a filter according to a third embodiment of the present invention is described with reference to FIG. 18.

Figure 18:
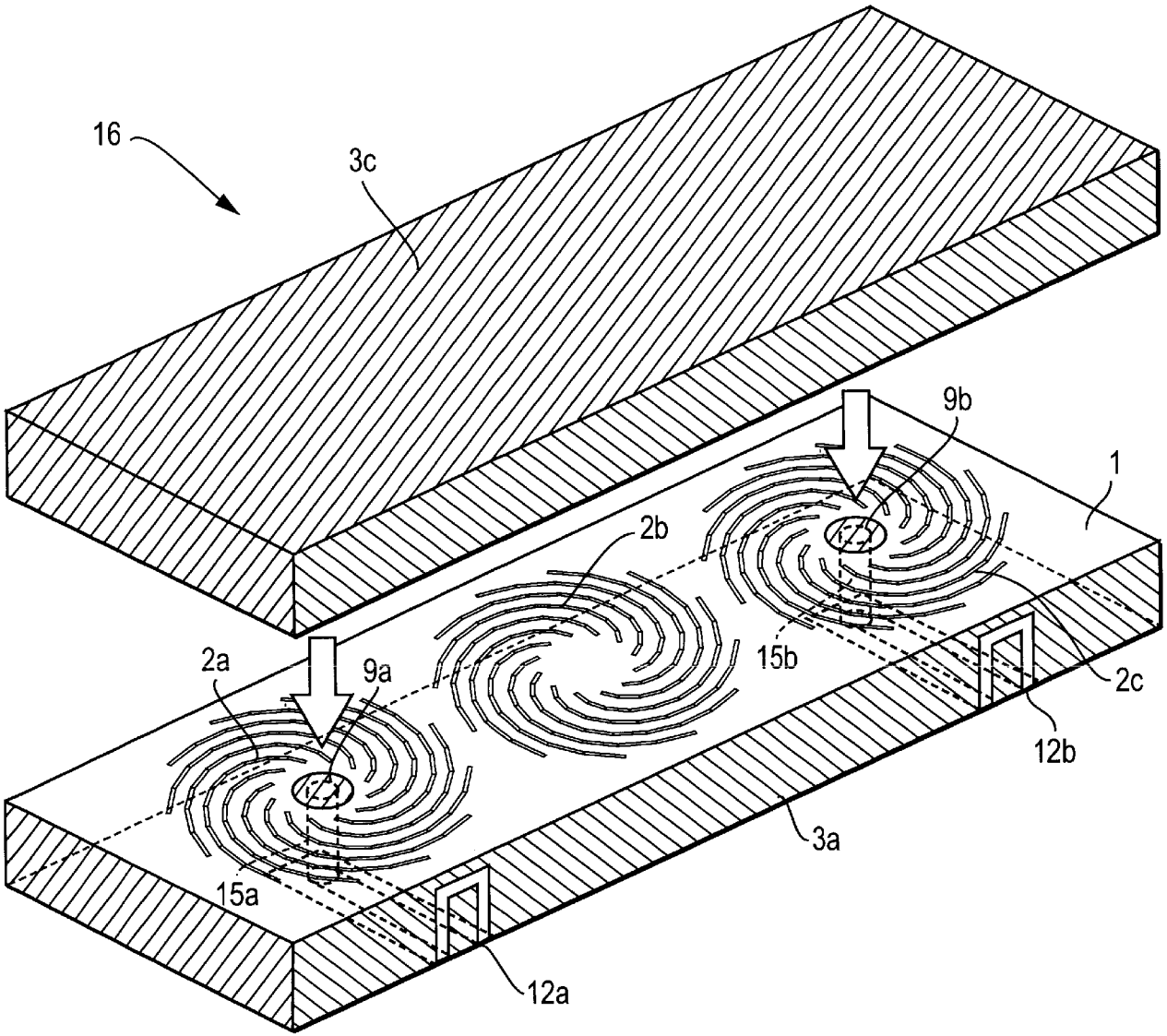
FIG. 18 is a perspective view of a filter according to a third embodiment of the present invention.

Referring to FIG. 18, three multiple spiral transmission line assemblies 2*a*, 2*b*, and 2*c* are provided on the top face of a dielectric substrate 1. At the centers of the end assemblies 2*a* and 2*b*, there are formed coupling pads 9*a* and 9*b*, respectively. On the dielectric substrate 1, there are also formed input and output terminals 12*a* and 12*b* each extending from the side face to the bottom face thereof. The side and bottom faces of the dielectric substrate 1 are substantially covered by a ground electrode 3*a*, except where the terminals 12*a* and 12*b* are formed. Formed through the dielectric substrate 1 are through-holes 15*a* and 15*b* for electrically connecting the coupling pads 9*a* and 9*b* respectively to the input and output terminals 12*a* and 12*b*. There is also provided an upper substrate 16 which is either insulating or dielectric, the top and side faces thereof being covered by a ground electrode 3*c*. By laminating the dielectric substrate 1 and the upper substrate 16 as indicated by the arrows, the three multiple spiral transmission line assemblies 2*a*, 2*b*, and 2*c* are sandwiched therebetween, thereby being surrounded by the ground electrodes 3*a* and 3*c*. Each of the transmission lines constituting the assemblies 2*a*, 2*b*, and 2*c* acts as a strip line. Accordingly, signals are filtered between the input and output terminals 12*a* and 12*b* in accordance with the band-pass characteristics determined by the three resonators.

Next, the construction of a filter according to a fourth embodiment of the present invention is described with reference to FIG. 19.

Figure 19:
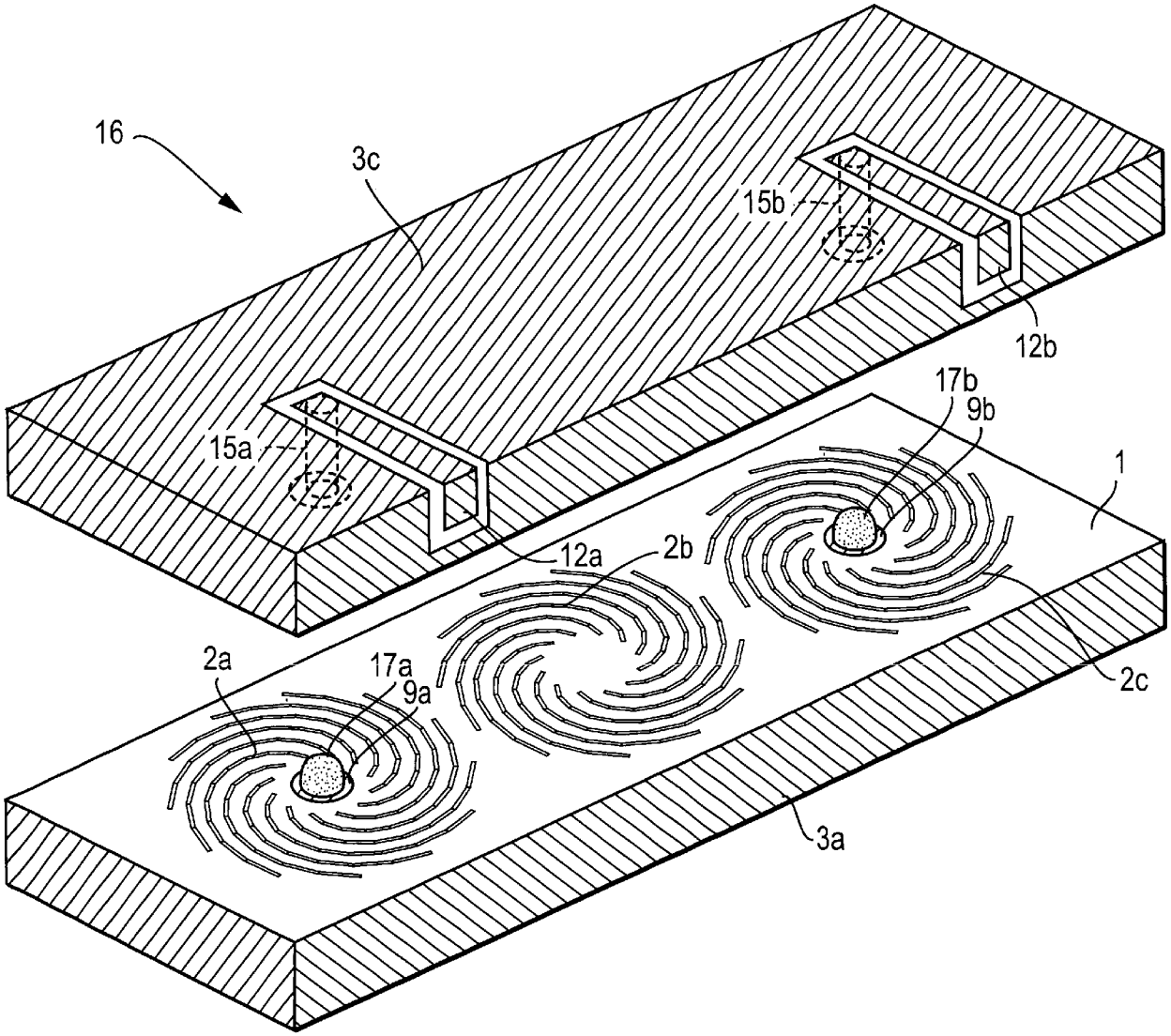
FIG. 19 is a perspective view of a filter according to a fourth embodiment of the present invention.

Referring to FIG. 19, three multiple spiral transmission line assemblies 2*a*, 2*b*, and 2*c* are provided on the top face of a dielectric substrate 1. At the centers of the end assemblies 2*a* and 2*b*, there are formed coupling pads 9*a* and 9*b*, respectively. On top of the coupling pads 9*a* and 9*b*, there are formed conductive bumps 17*a* and 17*b*, respectively. The bottom and side faces of the dielectric substrate 1 are substantially covered by a ground electrode 3*a*. There is also provided an upper substrate 16. (The top surface of the upper substrate 16 will serve as the mounting surface when mounted on a mounting board.) On the upper substrate 16, there are formed input and output terminals 12*a* and 12*b* extending from the top face to the side face thereof. The top and side faces of the upper substrate 16 are covered by a ground electrode 3*c* except where the input and output terminals 12*a* and 12*b* are formed. On the bottom face of the upper substrate 16, there are formed electrodes for contact with the bumps 17*a* and 17*b*. Formed through the upper substrate 16 are through-holes 15*a* and 15*b* electrically connecting the electrodes and the input and output terminals 15*a* and 15*b*.

By laminating the dielectric substrate 1 and the upper substrate 16, the electrodes on the bottom face of the upper substrate 16 are electrically connected to the coupling pads 9*a* and 9*b* via the bumps 17*a* and 17*b*, respectively. Accordingly, signals between the input and output terminals 12*a* and 12*b* are filtered in accordance with the band-pass characteristics determined by the three resonators.

Next, examples of modifications of the electrodes connected to the coupling pads are described with reference to FIGS. 20A–21B.

Figure 20A:
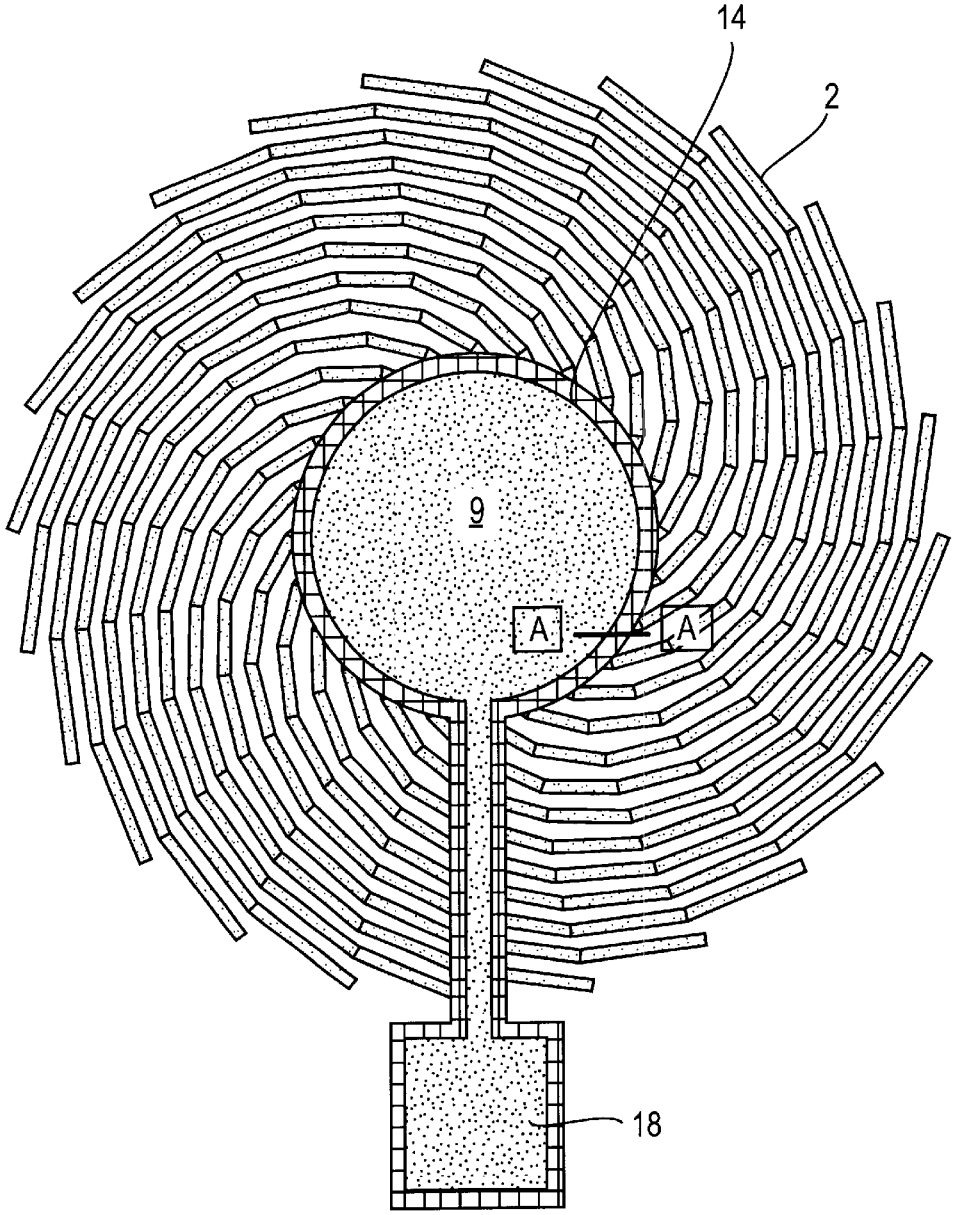
FIG. 20A is a plan view showing a modification of the electrode connected to the coupling pad.
Figure 20B:
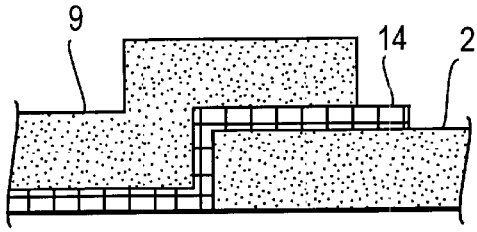
FIG. 20B is a vertical section taken along the line A—A in FIG. 20A.

In FIG. 20A, a multiple spiral transmission line assembly 2 is formed on a dielectric substrate 1, and a dielectric film 14 is formed so as to cover the inner end portion of the assembly 2 and to extend in one direction beyond the inner end of the assembly 2. On the dielectric film 14, there are formed a coupling pad 9 and an outer pad 18 extending therefrom. FIG. 20B shows a vertical section taken along the line A—A in FIG. 20A.

Figure 21A:
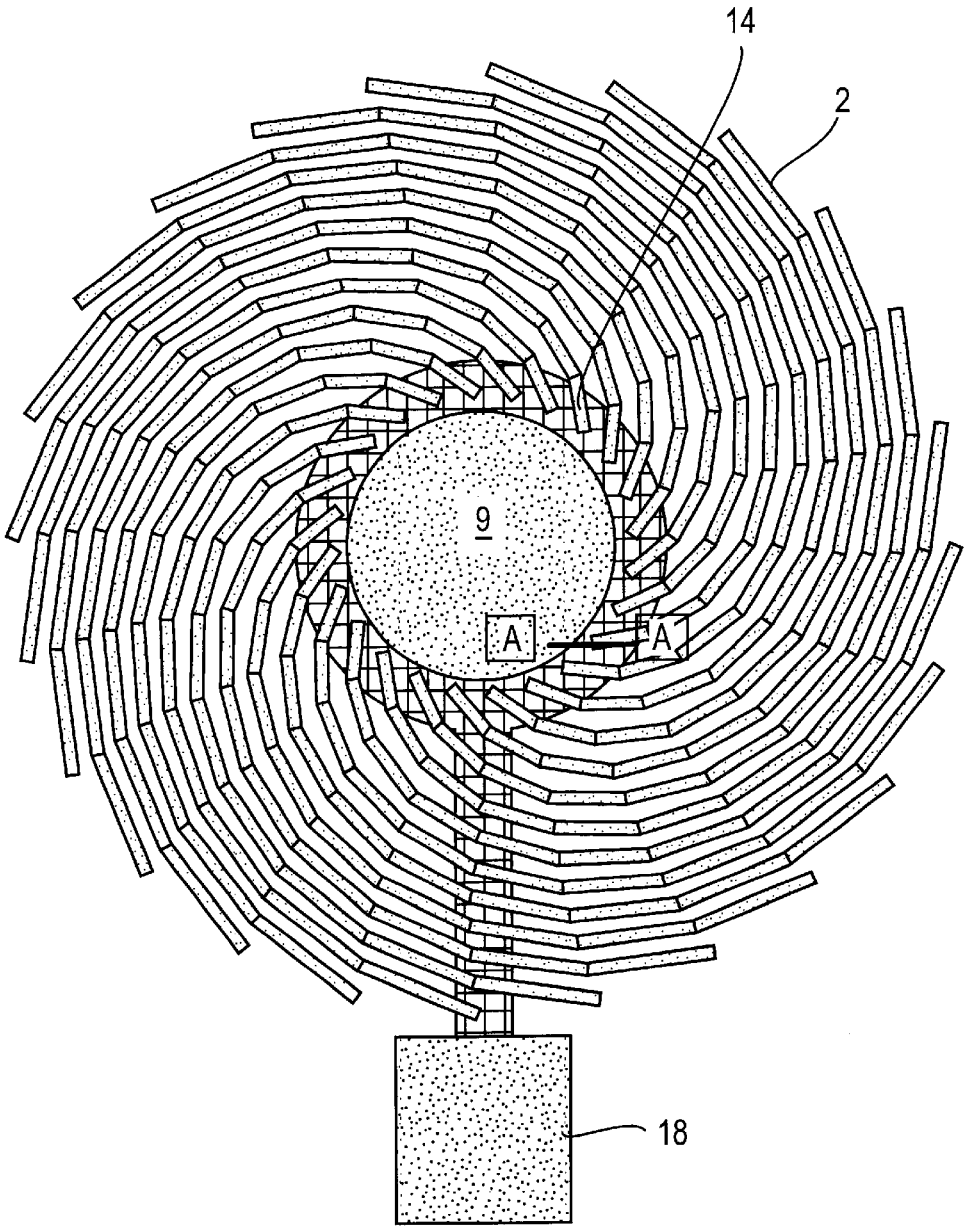
FIG. 21A is a plan view showing another modification of the electrode.
Figure 21B:
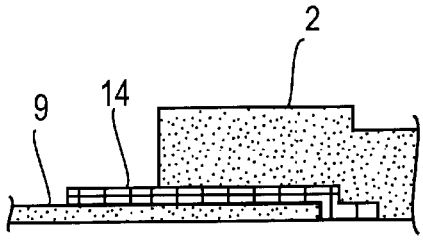
FIG. 21B is a vertical section taken along the line A—A in FIG. 21A.

In FIG. 21A, a coupling pad 9 and an outer pad 18 extending therefrom are formed on a dielectric substrate 1, a dielectric film 14 is formed so as to cover the outer end portion of the coupling pad 9 and the portion extending between the coupling pad 9 and the outer pad 18, and the multiple spiral transmission line assembly 2 is formed over the dielectric film 14. FIG. 21B shows a vertical section taken along the line A—A in FIG. 21A.

In the above structures, the coupling pad 9 is capacitively coupled to the inner end portion of the assembly 2, and the outer pad 18 is used as an input or output terminal, or as an electrode for electrically connecting the coupling pad 9 to an input or output terminal. Accordingly, no space is required for disposing bonding wires, and the complex processes required for fabricating through-holes are eliminated.

Figure 22:
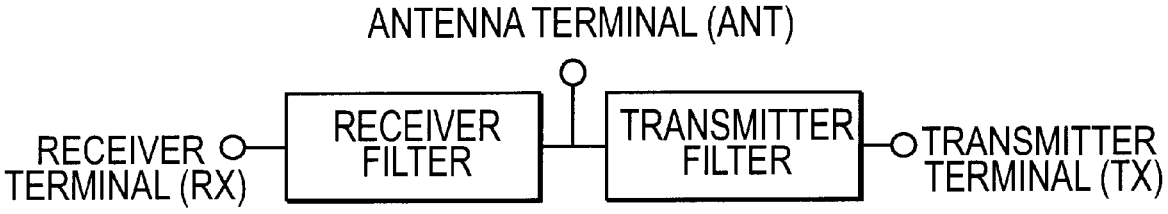
FIG. 22 is a block diagram of a duplexer according to the present invention.

FIG. 22 is a block diagram showing the construction of a duplexer according to the present invention. The duplexer includes a receiver filter and a transmitter filter, each of which is constructed in accordance with any one of the above-described embodiments. A duplexing line carries both a transmitted signal from the transmitter filter to an antenna terminal (ANT), and carries a received signal from the antenna terminal to the receiver filter. Input and output terminals TX and RX, for connection respectively to a transmitter and a receiver, for example, are provided on a substrate (not shown). The substrate may correspond to the substrate 6 in the above embodiments. On the substrate, a dielectric substrate for the transmitting filter and another dielectric substrate for the receiving filter may be disposed. There may alternatively be separate substrates for the two filters, and/or for the duplexing line. The coupling pads associated with the input-end and output-end resonators of each of the filters are wire-bonded to the duplexing line. The input and output terminals of the filters are provided on substrate. Thus, interference between transmitted signals and received signals is prevented, and only the transmitted signals within the transmitting frequency band are fed to the antenna, and only the received signals within the receiving frequency band are fed to the receiver circuit.

Figure 23:
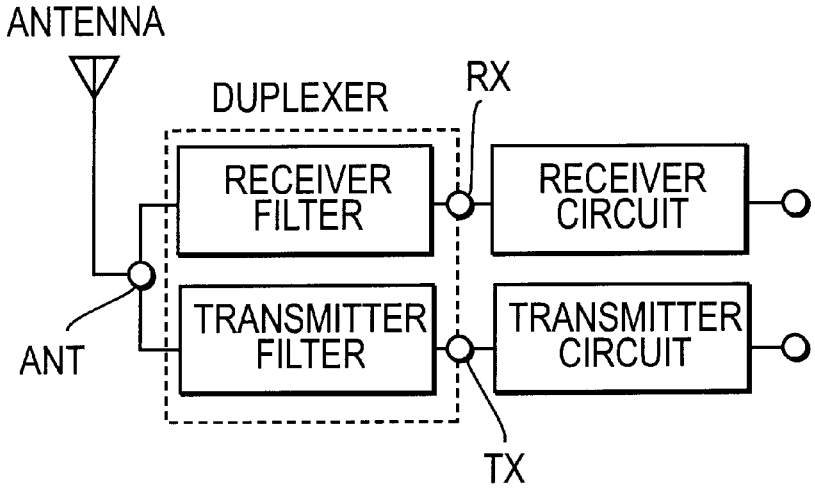
FIG. 23 is a block diagram of a communications device according to the present invention.

FIG. 23 is a block diagram showing the construction of a communications device according to the present invention. The communications device incorporates a duplexer as described above. A transmitter circuit and a receiver circuit are provided on a circuit board. The duplexer is mounted on the circuit board with the transmitter circuit connected to a TX terminal, the receiver circuit to an RX terminal, and an antenna to an ANT terminal.

Although the present invention has been described in relation to particular embodiments thereof, many other variations and modifications and other uses will become apparent to those skilled in the art. Therefore, the present invention is not limited by the specific disclosure herein.

What is claimed is:

1. A filter comprising:

a resonator including a substrate and a transmission line assembly, said transmission line assembly being constituted of a plurality of spiral transmission lines disposed around a point on said substrate so as not to cross one another, the inner ends and outer ends of said plurality of spiral transmission lines substantially defining, respectively, an inner circumference and an outer circumference of said transmission line assembly; and a coupling pad, disposed at said point at the center of said transmission line assembly, capacitively coupled to each of said plurality of spiral transmission lines.

2. A filter comprising:

a resonator including a substrate and a transmission line assembly, said transmission line assembly being constituted of a plurality of spiral transmission lines disposed in rotational symmetry with one another around a point on said substrate so as not to cross one another; and a coupling pad, disposed at said point at the center of said transmission line assembly, capacitively coupled to each of said plurality of spiral transmission lines.

3. A filter comprising:

a resonator including a substrate and a transmission line assembly, said transmission line assembly being constituted of a plurality of transmission lines disposed on said substrate, each of said plurality of transmission lines being represented by either a monotonically-increasing line or a monotonically-decreasing line on coordinates defined by an angle axis and a radius vector axis, the line width of each of said plurality of transmission lines not exceeding an angle width of $2\pi$ radians divided by the number of the transmission lines, the width of the entirety of said transmission line assembly not exceeding the angle width of $2\pi$ radians at any radius vector; and a coupling pad, disposed at the center of said transmission line assembly, capacitively coupled to each of said plurality of transmission lines.

4. A filter according to any one of claims 1 to 3, wherein said coupling pad is formed on a common plane with said transmission line assembly.

5. A filter according to claim 4, wherein said substrate is laminated onto another substrate provided with an input terminal and an output terminal, and said coupling pad is connected, via a bump, to an electrode connected to one of the input terminal and the output terminal.

6. A filter according to any one of claims 1 to 3, wherein said coupling pad is disposed so as to partially overlap said transmission line assembly, with a dielectric member interposed between said coupling pad and said transmission line assembly.

7. A filter according to claim 6, wherein said substrate is laminated onto another substrate provided with an input terminal and an output terminal, and said coupling pad is connected, via a bump, to an electrode connected to one of the input terminal and the output terminal.

8. A filter according to any one of claims 1 to 3, wherein said substrate is laminated onto another substrate provided with an input terminal and an output terminal, and said coupling pad is connected, via a bump, to an electrode connected to one of the input terminal and the output terminal.

9. A duplexer comprising a transmitting filter and a receiving filter, one or both of said filters being a filter according to any one of claims 1 to 3, each said filter having respective input and output electrodes, said output electrode of said transmitting filter and said input electrode of said receiving filter being connected in common to an antenna terminal; said input electrode of said transmitting filter being connected to a transmitter terminal, and said output electrode of said receiver terminal being connected to a receiver terminal.

10. A communications device comprising a duplexer according to claim 9, a transmitter connected to said transmitter terminal and a receiver connected to said receiver terminal.

11. A communications apparatus comprising a filter according to any one of claims 1 to 3, and connected thereto a high-frequency circuit comprising at least one of a transmitting circuit and a receiving circuit.

* * * * *